US008191997B2

(12) United States Patent
Ono et al.

(10) Patent No.: US 8,191,997 B2
(45) **Date of Patent: *Jun. 5, 2012**

(54) LIQUID DROPLET JETTING APPARATUS AND LIQUID DROPLET JETTING HEAD

(75) Inventors: Masashi Ono, Okazaki (JP); Yasuhiro Sekiguchi, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 272 days.

This patent is subject to a terminal disclaimer.

(21) Appl. No.: 12/413,413

(22) Filed: Mar. 27, 2009

(65) Prior Publication Data

US 2009/0244204 A1 Oct. 1, 2009

(30) Foreign Application Priority Data

Mar. 31, 2008 (JP) ..... 2008-094172

(51) Int. Cl.
*B41J 2/045* (2006.01)

(52) U.S. Cl. ..... 347/71; 347/68

(58) Field of Classification Search ..... 347/68–72
See application file for complete search history.

(56) References Cited

U.S. PATENT DOCUMENTS 6,863,383 B2 * 3/2005 Takahashi ..... 347/72
7,073,894 B2 7/2006 Isono et al.
7,914,103 B2 * 3/2011 Katayama et al. ..... 347/19
2005/0231073 A1 10/2005 Sugahara et al.
2009/0085984 A1 * 4/2009 Kojima ..... 347/68
2009/0096844 A1 4/2009 Kojima et al.

FOREIGN PATENT DOCUMENTS

JP 2002-019113 A 1/2002
JP 2002-254640 A 9/2002
JP 2005-059551 A 3/2005
JP 2005-317952 A 11/2005
JP 2007-256922 A 9/2007

* cited by examiner

*Primary Examiner* — Geoffrey Mruk

(74) *Attorney, Agent, or Firm* — Baker Botts L.L.P.

(57) ABSTRACT

A piezoelectric actuator includes piezoelectric material layers, individual electrodes corresponding to pressure chambers, a first common constant electric potential electrode corresponding to outer peripheral portions of the pressure chambers, and a second common constant electric potential electrode corresponding to central portions of the individual electrodes. A plurality of first active portions is formed in areas of the piezoelectric material layers sandwiched between the individual electrodes and the second common constant electric potential electrode, and a plurality of second active portions is formed in areas of the piezoelectric material layers sandwiched between the individual electrodes and the first common constant electric potential electrode. Since the second common constant electric potential electrode has a mesh-shaped form, it is possible to reduce an impedance thereof.

14 Claims, 18 Drawing Sheets

LIQUID DROPLET JETTING APPARATUS AND LIQUID DROPLET JETTING HEAD

CROSS REFERENCE TO RELATED APPLICATION

The present application claims priority from Japanese Patent Application No. 2008-094172, filed on Mar. 31, 2008, the disclosure of which is incorporated herein by reference in its entirety.

BACKGROUND OF THE INVENTION

1. Field of the Invention

The present invention relates to a liquid droplet jetting apparatus and a liquid droplet jetting head.

2. Description of the Related Art

As a liquid droplet jetting apparatus, an ink-jet printer which includes a cavity unit in which a plurality of pressure chambers is arranged regularly, an ink-jet head in which a piezoelectric actuator for jetting an ink in the pressure chambers selectively is joined to the cavity unit, and a voltage applying mechanism which applies a voltage to the piezoelectric actuator has hitherto been known. Moreover, as the piezoelectric actuator described above, a longitudinal-effect actuator of a stacked type (refer to U.S. Pat. No. 7,073,894 B2, corresponding to Japanese Patent Application Laid-open No. 2005-59551 for example), and a unimorph actuator (refer to US2005/0231073 A1, corresponding to Japanese Patent Application Laid-open No. 2005-317952) have been known.

In an ink-jet head of such printer, a high densification of pressure chambers has been sought for securing a high quality and a high image quality of recording by increasing the number of nozzles. When the pressure chambers are arranged in a row highly densely, since a distance between the adjacent pressure chambers becomes short, an effect of the adjacent pressure chamber at the time of driving becomes substantial, thereby causing a problem of a so-called cross-talk.

An ink-jet head, as shown in FIGS. 14 and 15 for example, has a piezoelectric actuator 912 having three piezoelectric material layers 912*a*, 912*b*, and 912*c*, a cavity unit 940 in which pressure chambers 914*a* are arranged regularly, and a confining plate 115 which is joined between the cavity unit 914 and the piezoelectric actuator 912. Moreover, on an upper surface of the piezoelectric material layers 912*a* and 912*c*, individual electrodes 921 are formed corresponding to the pressure chambers 940, and on a lower surface of the piezoelectric material layers 912*a* and 912*c*, a constant electric potential electrode (a controlled (fixed) electric potential electrode) 922 (ground electric potential electrode 922) is formed. In this case, at the time of applying a positive electric potential (for example an electric potential of 20V) to the individual electrodes 921 selectively, areas of the piezoelectric material layer sandwiched between the individual electrodes 921 and the constant electric potential electrode 922 function as active portions S each of which makes jet the ink from a nozzle hole 914*b* by changing a volume of one of the pressure chambers 940. A deformation of the active portions S (piezoelectric material layers 912*a* to 912*c*) for such ink jetting affects not only the one of the pressure chambers 940 jetting the ink but also another pressure chamber 940 adjacent to the one of the pressure chambers 940.

Therefore, a defect such as a fluctuation in jetting characteristics of the adjacent pressure chamber 940 (such as an unintentional jetting of the ink from the nozzle hole 114*b*), in other words, the cross-talk has been occurring.

For solving a problem of such cross-talk, various measures have been proposed. For example, in a head described in Japanese Patent Application Laid-open No. 2002-254640 (FIG. 2), a beam portion 100 is provided between partition walls 11 on two sides in a width direction of a pressure generation chamber 12, and a stiffness of the partition walls 11 is improved. Accordingly, the cross-talk is prevented from occurring between the adjacent pressure generating chambers.

Moreover, in a head described in Japanese Patent Application Laid-open No. 2002-19113, an elastic body 7 is arranged in an area occupying a predetermined depth and a predetermined width from a nozzle plate 3, of a side wall 5 which demarcates each pressurized liquid chamber 4. Accordingly, a mechanical cross-talk is reduced.

SUMMARY OF THE INVENTION

However, with advancement in the high densification of the pressure chambers, these measures have no longer been sufficient measures. Particularly, in a case of a unimorph actuator, the cross-talk due to a deformation of the adjacent pressure chambers has been substantial. When the pressure chambers are arranged further highly densely, not only the cross-talk between the adjacent pressure chambers in the same pressure chamber row but also the cross-talk between the pressure chambers of the adjacent pressure chamber rows has been a concern.

Inventors of the present invention have invented a piezoelectric actuator which is capable of suppressing the cross-talk even when the pressure chambers are arranged highly densely, and filed a patent application for the same (refer to Japanese Patent Application No. 2007-256922). Here, the piezoelectric actuator according to the above mentioned invention includes first active portions corresponding to central portions of pressure chambers, second active portions corresponding to portions on outer peripheral side of the central portions of the pressure chambers, individual electrodes which are formed to cover first areas corresponding to the first active portions and second areas corresponding to the second active portions, a first constant electric potential electrode which is formed to cover the first areas, and a second constant electric potential electrode which is formed to cover at least the second areas. Accordingly, it is possible to suppress a propagation of a deformation of the first active portions toward the adjacent pressure chamber, by a deformation of the second active portion. Further, it is possible to prevent the cross-talk between the adjacent pressure chambers in a row direction of the pressure chamber row.

In this case, as shown in FIG. 16 for instance, a piezoelectric actuator 212 includes a stacked body of two piezoelectric material layers 212*a* and 212*b*, a second constant electric potential electrode 223 (positive electric potential) arranged between the piezoelectric material layers 212*a* and 212*b*, individual electrodes 221 which is arranged on one surface of the stacked body and to which a positive electric potential and a ground electric potential are applied selectively, and a first constant electric potential electrode 222 (ground electric potential) which is arranged on the other surface of the stacked body. In the piezoelectric actuator 212, for reducing the number of signal wires for applying the electric potential to both of the first constant electric potential electrode 222 and the second constant electric potential electrode 223, it can be considered that a common constant electric potential is applied to each of the first constant electric potential electrode 222 and the second constant electric potential electrode 223 as shown in FIGS. 17 and 18. An electroconductive material is filled in through holes 222*a* and 223*c* for wiring the first constant electric potential electrode 222 and the second constant electric potential electrode 223 upon guiding to the upper surface of the stacked body.

Here, as shown in FIGS. 16, 17, and 18, the second constant electric potential electrode 223 is a common electrode which includes first electrode portions 223*a* corresponding to the individual electrodes 221 respectively, and second electrode portions 223*b* which connect the first electrode portions 223*a*. Since the second constant electric potential electrode 223 applies the positive electric potential unlike the first constant electric potential electrode 222, when it is possible to reduce an impedance of the second constant electric potential electrode 223, it is possible to prevent a voltage drop, and it is possible to apply a uniform voltage to any of the first electrode portions 223*a*.

An object of the present invention is to reduce the impedance of the second common constant electric potential electrode in a liquid droplet jetting apparatus and a liquid droplet jetting head which includes a piezoelectric actuator having an individual electrode, and two common constant electric potential electrodes namely a first common constant electric potential electrode and a second common constant electric potential electrode.

According to a first aspect of the present invention, there is provided a liquid droplet jetting apparatus which jets a droplet of a liquid onto a medium, including a liquid droplet jetting head which jets the droplet, including:

a cavity unit in which a plurality of pressure chamber rows each having a plurality of pressure chambers aligned in a row direction is formed; and a piezoelectric actuator which causes selectively the liquid in each of the pressure chambers to be jetted, and includes a plurality of piezoelectric material layers stacked covering the pressure chambers; a plurality of individual electrodes arranged on a first surface of the piezoelectric material layers, at positions corresponding to the pressure chambers, respectively; a first common constant electric potential electrode which is formed on a second surface of the piezoelectric material layers, which overlaps with a portion of each of the individual electrodes, and which forms a plurality of second active portions in areas of the piezoelectric material layers each sandwiched between one of the individual electrodes and the first common constant electric potential electrode; and a second common constant electric potential electrode which is formed on a third surface of the piezoelectric material layers, which has a form of a mesh overlapping with a central portion of each of the individual electrodes, and which forms a plurality of first active portions in an area, of the piezoelectric material layers, each sandwiched between one of the individual electrodes and the second common constant electric potential electrode; and a voltage applying mechanism which applies a voltage to the piezoelectric actuator, wherein when a voltage is applied to the first active portions and the second active portions by the voltage applying mechanism, the first active portions and the second active portions both elongate in a first direction toward the pressure chambers, and contract in a second direction which is orthogonal to the first direction, respectively, and when the voltage applying mechanism applies the voltage to the first active portions, the voltage applying mechanism does not apply the voltage to the second active portions, and when the voltage applying mechanism does not apply the voltage to the first active portions, the voltage applying mechanism applies the voltage to the second active portions.

Since the second common constant electric potential electrode is formed in the form of a mesh, an impedance of the second common constant electric potential electrode formed on the piezoelectric material layer is reduced. Accordingly, a voltage drop is prevented by the reduction in the impedance, and the voltage applied to the first active portion is stabilized, thereby making it possible to make jet the liquid in any pressure chamber in the same manner.

Here, an 'active portion' means a portion of the piezoelectric material layer which deforms when a voltage is applied and which does not deform when no voltage is applied. Moreover, the 'second active portion' may exist to be spread over a portion corresponding to the pressure chamber and a portion corresponding to a columnar portion between the pressure chambers. Further, the second active portion may exist a portion corresponding to the columnar portion which is different from a portion corresponding to the pressure chamber. Further, the second active portion may exist only a portion corresponding to the pressure chamber. The 'first direction' means a direction in which, the pressure chamber and the active portion are arranged, or in other words, means a stacking direction of the piezoelectric actuator and the cavity unit. The 'piezoelectric material layer' may be a layer of a piezoelectric sheet which is manufactured by baking a so-called green sheet, or may be a layer of a piezoelectric material manufactured by a manufacturing method such as so-called aerosol deposition method (AD method). Or, the piezoelectric material layer may be formed by other method (such as a hydrothermal synthesis method and a sol-gel method).

In the liquid droplet jetting apparatus according to the present invention, the second common constant electric potential electrode may be formed on the third surface of the piezoelectric material layers at portions which are different from another portions of the third surface overlapping with the terminal portions. In other words, the portion of the second common constant electric potential electrode overlapping with the terminal portion may be a void. Here, 'void' means there is no electrode portion of the second common constant electric potential electrode due to forming a hole in the second common constant electric potential electrode, at a site overlapping with the terminal portion of the individual electrode.

According to a second aspect of the present invention, there is provided a liquid droplet jetting head which jets a droplet of a liquid onto a medium, including a liquid droplet jetting head which jets the droplet, including:

a cavity unit in which a plurality of pressure chamber rows each having a plurality of pressure chambers aligned in a row direction is formed;

a piezoelectric actuator which causes selectively the liquid in the pressure chambers to be jetted, and includes a plurality of piezoelectric material layers stacked covering the pressure chambers; a plurality of individual electrodes arranged on a first surface of the piezoelectric material layers, at positions corresponding to the pressure chambers, respectively; a first common constant electric potential electrode which is formed on a second surface of the piezoelectric material layers, which overlaps with a portion of each of the individual electrodes, and which forms a plurality of second active portions in areas of the piezoelectric material layers each sandwiched between one of the individual electrodes and the first common constant electric potential electrode; and a second common constant electric potential electrode which is formed on a third surface of the piezoelectric material layers, which has a form of a mesh overlapping with a central portion of each of the individual electrodes, and which forms a plurality of first active portions in areas of the piezoelectric material layers each sandwiched between one of the individual electrodes and the second common constant electric potential electrode; and a voltage applying mechanism which applies a voltage to the piezoelectric actuator, wherein the voltage applying mechanism switches, between a first mode for applying the voltage and a second mode for not applying the voltage, to one of the first active portions to change a volume of one of the pressure chambers, and switches, between a third mode for applying the voltage and a fourth mode for not applying the voltage, to one of the second active portions to suppress a deformation of the one of the first active portions from being propagated to an adjacent pressure chamber of the one of the pressure chambers due to the switching between the first and second modes.

According to the second aspect of the present invention, since the second common constant electric potential electrode is formed to be in the form of a mesh (net), an impedance of the second common constant electric potential electrode formed on the piezoelectric material layer is reduced. Accordingly, a voltage drop is prevented by the reduction in the impedance, and a voltage applied (application of voltage) to the first active portion is stabilized, thereby making it possible to make jet the liquid in any pressure chamber in the same manner.

According to a third aspect of the present invention, there is provided a liquid droplet jetting head which jets a droplet of a liquid onto a medium, including a cavity unit in which a plurality of pressure chamber rows each having a plurality of pressure chambers aligned in a row direction is formed; and a piezoelectric actuator which causes selectively the liquid in the pressure chambers to be jetted, including:

a plurality of piezoelectric material layers stacked covering the pressure chambers, respectively;

a plurality of individual electrodes arranged on a first surface of the piezoelectric material layers, at positions corresponding to the pressure chambers;

a first common constant electric potential electrode which is formed on a second surface of the piezoelectric material layers, which overlaps with a portion of each of the individual electrodes, and which forms a plurality of second active portions in areas of the piezoelectric material layers, each sandwiched between one of the individual electrodes and the piezoelectric material layer; and a second common constant electric potential electrode which is formed on a third surface of the piezoelectric material layers, which has a form of a mesh overlapping with a central portion of each of the individual electrodes, and which forms a plurality of first active portions in areas, of the piezoelectric material layers, each sandwiched between one of the individual electrodes and the piezoelectric material layer.

According to the third aspect of the present invention, since the second common constant electric potential electrode is formed to be in the form of a mesh (net), an impedance of the second common constant electric potential electrode formed on the piezoelectric material layer is reduced. Accordingly, a voltage drop is prevented by the reduction in the impedance, and a voltage applied (application of voltage) to the first active portion is stabilized, thereby making it possible to make jet the liquid in any pressure chamber in the same manner.

In the piezoelectric actuator according to the present invention, the portion of the piezoelectric material layer sandwiched between the second common constant electric potential electrode and the individual electrode forms the first active portion. The inventors of the present invention, in a case of the second common constant electric potential electrode having a plurality of free ends (such as an end portion of a first electrode portion 223*a* shown in FIG. 17, on an opposite side of and end portion to which a second electrode portion 223*b* is connected), have considered (have assumed) that the impedance of the second common constant electric potential becomes high, and formed the second common constant electric potential electrode in the form of a mesh (net). Therefore, it is possible to reduce the impedance of the second common constant electric potential electrode which forms the first active portion which is involved in the jetting of the liquid in the pressure chamber. Accordingly, by reducing the impedance of the second common constant electric potential electrode, the voltage drop is reduced, and a voltage applied to the first active portion is stabilized, thereby making it possible to make jet the liquid in any pressure chamber in the same manner.

DETAILED DESCRIPTION OF THE PREFERRED EMBODIMENTS

First Embodiment

Figure 1A:
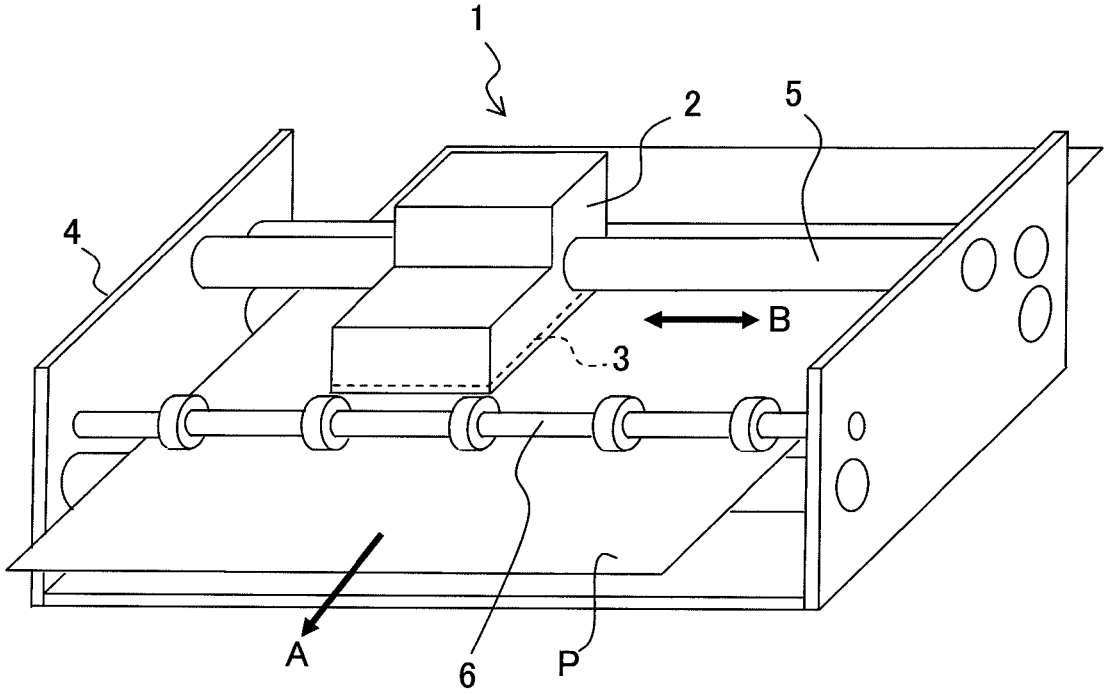
FIG. 1A is a schematic structural view showing a schematic structure of an ink-jet printer (liquid droplet jetting apparatus) according to the present invention.

Exemplary embodiments of the present invention will be described below with reference to the accompanying diagrams. FIG. 1A is a schematic structural view showing a schematic structure of an ink-jet printer (liquid droplet jetting apparatus) according to the present invention, and FIG. 1B is an explanatory diagram showing a relationship of a cavity unit, and a piezoelectric actuator and a flexible printed circuit (FPC)/a chip on board (COB, COP) according to the present invention.

An ink-jet printer 1 according to the present invention, as shown in FIG. 1A, includes a carriage 2 on which ink cartridges (not shown in the diagram) are mounted, and an ink-jet head 3 (liquid droplet jetting head) which is arranged on a lower surface of the carriage 2, and which carries out a recording by jetting an ink on to a recording paper P (recording medium). The carriage 2 is supported by a carriage shaft 5 and a guide plate (not shown in the diagram) provided inside a printer frame 4, and reciprocates in B-direction (a scanning direction, see FIG. 1) which is orthogonal to A-direction (a transporting direction) in which the recording paper P is transported. The recording paper P transported in A-direction by a paper feeding section which is not shown in the diagram is introduced between a platen roller (not shown in the diagram) and the ink-jet head 3. Then, a predetermined recording is carried out by the ink jetted toward the recording paper P from the ink-jet head 3, the recording paper P is discharged by a paper discharge roller 6.

Figure 1B:
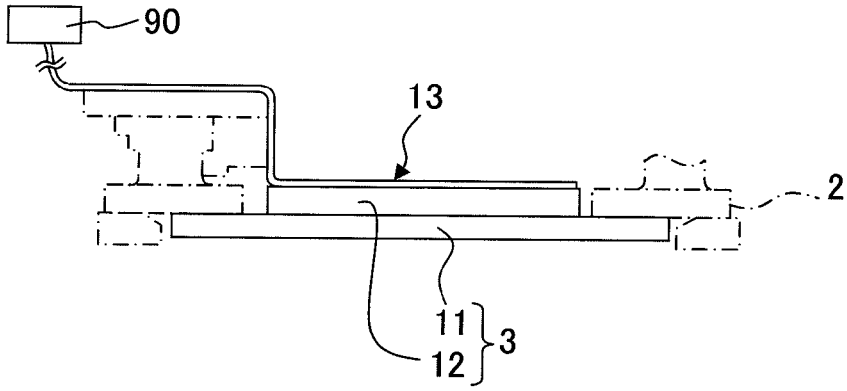
FIG. 1B is an explanatory diagram showing a relationship of a cavity unit, and a piezoelectric actuator and a flexible circuit board (FPC, COP) according to the present invention.

Moreover, as shown in FIG. 1B, the ink-jet head 3 includes a cavity unit 11, and a piezoelectric actuator 12 arranged on the cavity unit 11. A flexible circuit board 13 (signal wires) through which a drive signal is supplied is provided on an upper surface of the piezoelectric actuator 12.

Figure 2A:
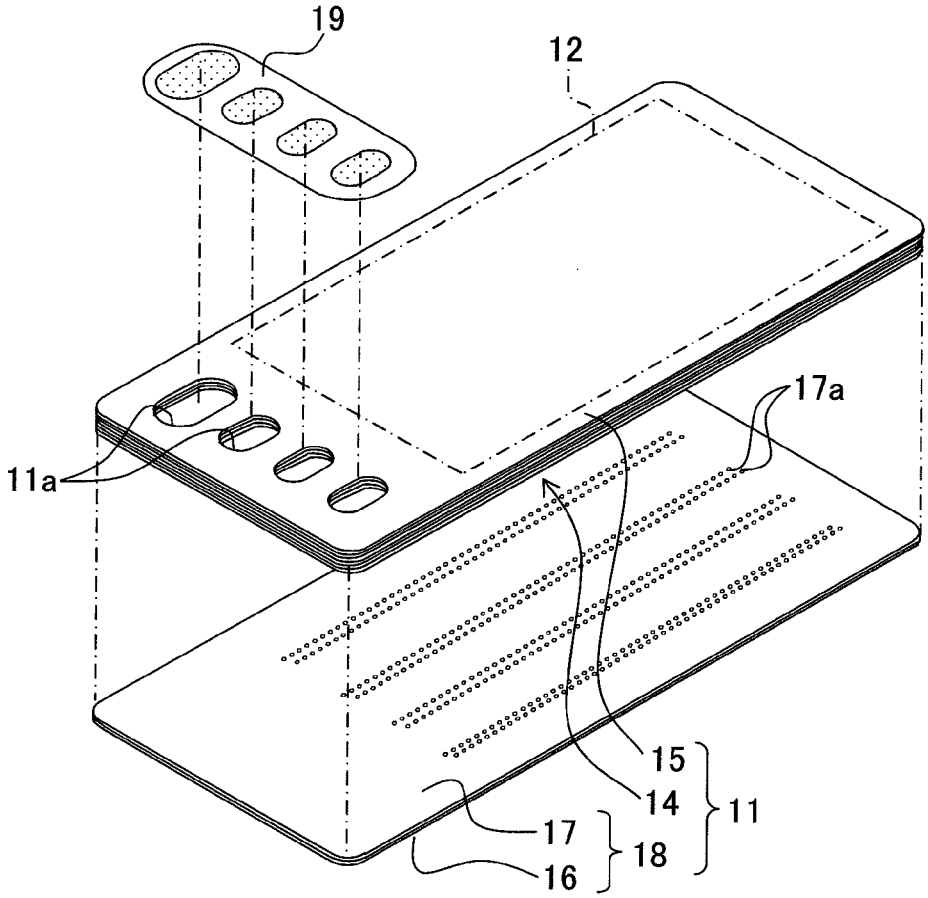
FIG. 2A is a perspective view showing a state in which the piezoelectric actuator is stuck on an upper side of the cavity unit.
Figure 2B:
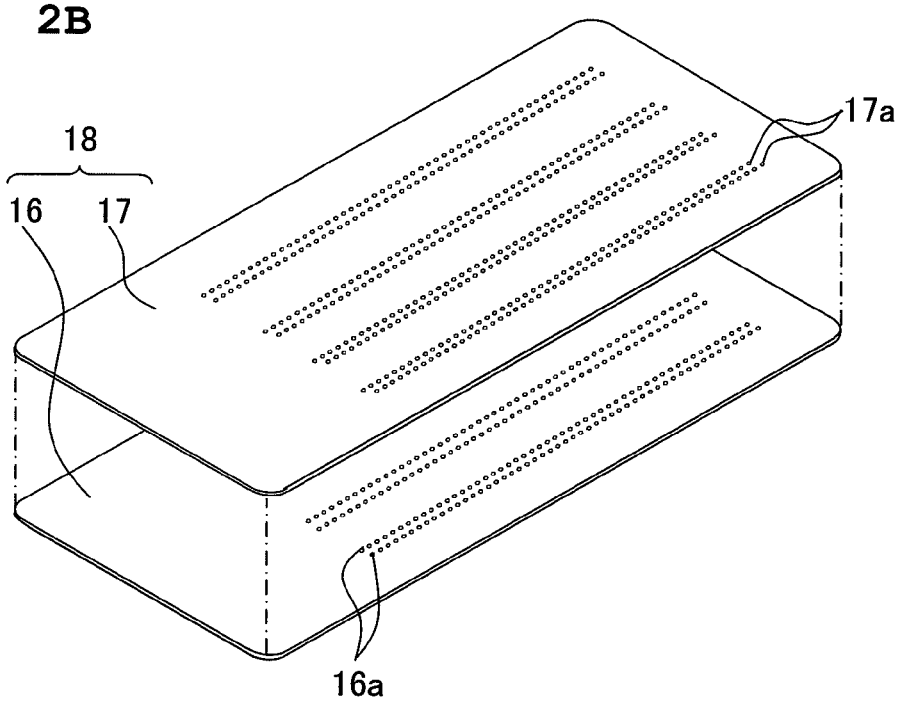
FIG. 2B is a perspective view showing the cavity unit.

The cavity unit 11, as shown in FIG. 2, includes a stacked body 14 made of a plurality of plate members. A top plate 15 is arranged on an upper side of the stacked body 14. A plate assembly 18 in which a nozzle plate 16 and a spacer plate 17 are stuck integrally, is provided on a lower side of the stacked body 14, the nozzle plate 16 having nozzle holes 16*a* formed therein, and a spacer plate 17 having through holes 17*a* corresponding to the nozzle holes 16*a* formed therein. Moreover, the piezoelectric actuator 12 for selectively jetting inks in a plurality of pressure chambers 40 which will be described later is joined to an upper side of the top plate 15. A filter 19 for trapping dust etc. in the ink is provided in an opening hole 11*a* in the cavity unit 11. The nozzle plate 16 is a plate of a synthetic resin material (such as polyimide resin), and the nozzle holes 16*a* are formed corresponding to the pressure chambers 40 formed in a cavity plate 14A which forms the stacked body 14. The nozzle plate 16 may be a metal plate.

Figure 3A:
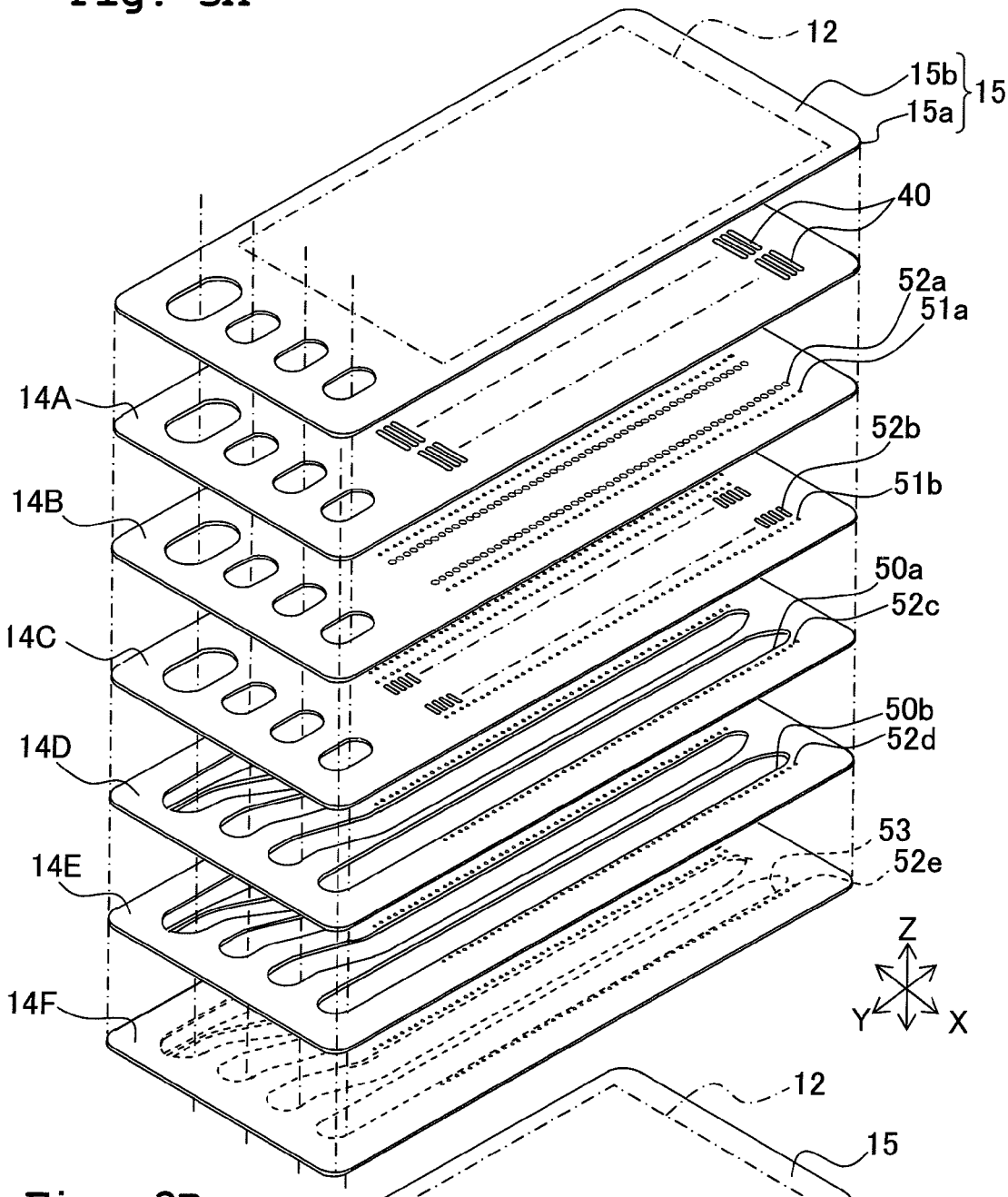
FIG. 3A is a diagram showing the cavity unit disassembled into various plates which are constituent elements of the cavity unit, together with a top plate.
Figure 3B:
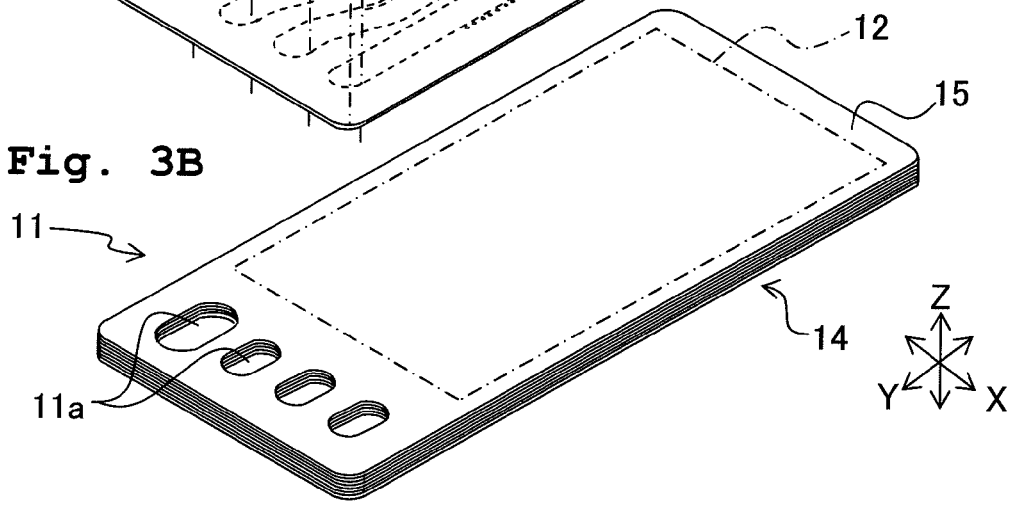
FIG. 3B is a diagram showing the assembled cavity unit.

The stacked body 14, as shown in FIG. 3, includes six metal plates (the cavity plate 14A, a base plate 14B, an aperture plate 14C, two manifold plates 14D and 14E, and a damper plate 14F), and is formed by stacking these plates in this order and joining by a metal diffusion joining. These six plates 14A to 14F are mutually aligned to form ink channels individually for each of the nozzle holes 16*a*. Here, the cavity plate 14A is a metal plate in which openings which function as the pressure chambers 40 are formed regularly corresponding to nozzle rows. These openings are lined up regularly to form a plurality of nozzle rows arranged in a predetermined direction (pressure chamber row direction X in FIGS. 4 and 5). Communicating holes 51*a* each of which forms a channel from a manifold 50 (common ink chamber) up to one of the pressure chambers 40, and communicating holes 52*a* each of which forms a channel from one of the pressure chambers 40 up to one of the nozzle holes 16*a* are formed in the base plate 14B. Communicating channels 21 each of which makes one of the pressure chambers 40 and the manifold 50 communicate are formed as recesses in an upper surface of the aperture plate 14C. Furthermore, communicating holes 51*b* which form channels from the manifold 50 up to the pressure chambers 40, and communicating holes 52*b* which form channels from the pressure chambers 40 up to the nozzle holes 16*a* are formed in the aperture plate 14C. Through holes 50*a* and 50*b* which form the manifold 50 are formed in the manifold plates 14D and 14E, and furthermore, communicating holes 52*c* and 52*d* which form channels from the pressure chambers 40 up to the nozzle holes 16 are formed in the manifold plates 14D and 14E. A damper chamber 53 is formed as a recess in a lower surface of the damper plate 14F, and furthermore, communicating holes 52*e* each of which forms a channel from one of the pressure chambers 40 up to one of the nozzle holes 16*a* are formed in the lower surface of the damper plate 14F.

In this manner, the cavity unit 11 includes the plurality of nozzle holes 16*a*, the plurality of pressure chambers 40 which communicate with the plurality of nozzle holes respectively, and the manifold 50 which temporarily stores an ink to be supplied to these pressure chambers 40.

Figure 4:
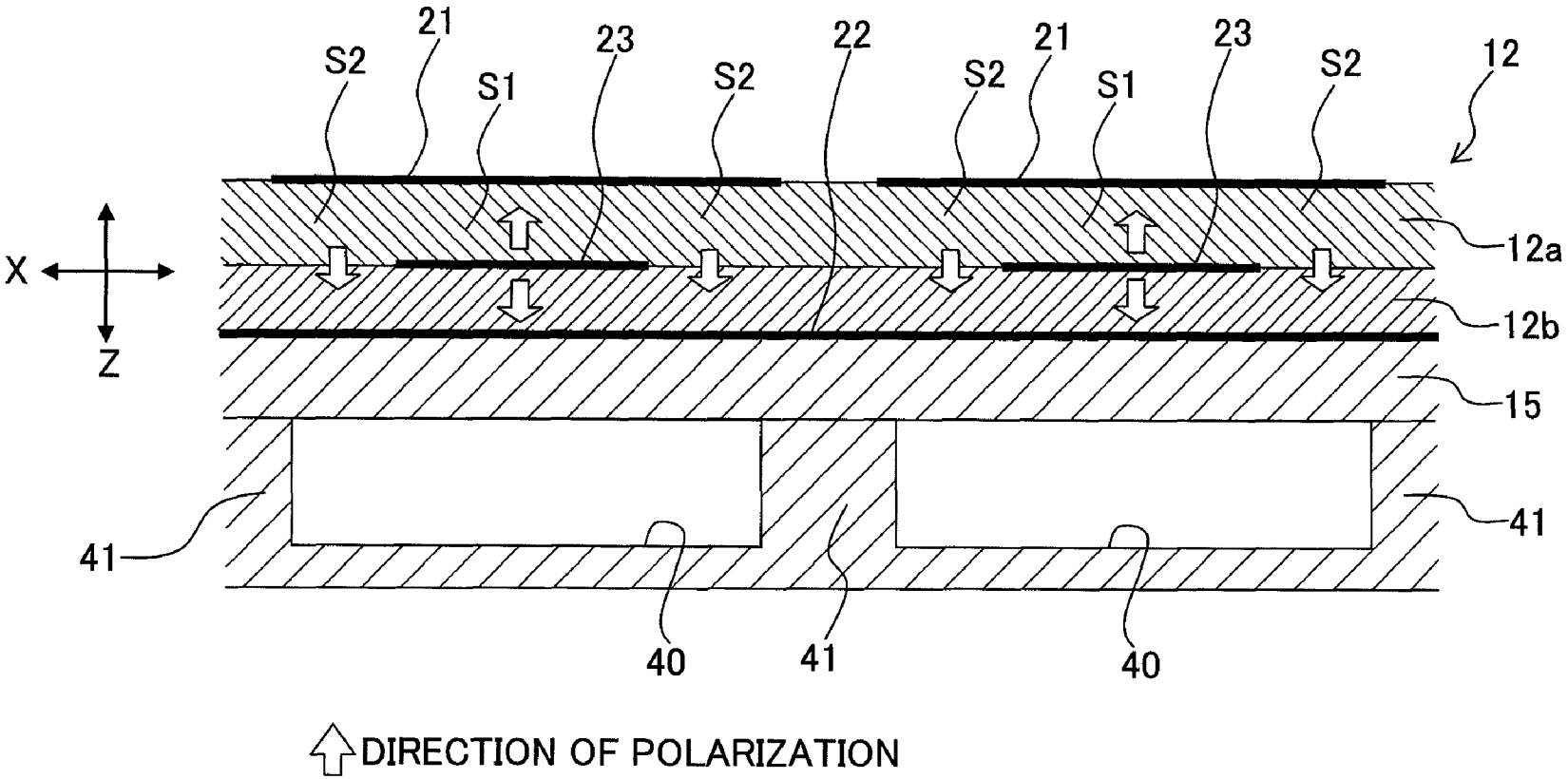
FIG. 4 is a cross-sectional view showing an arrangement of electrodes on each piezoelectric material layer of a piezoelectric actuator in a first embodiment.

The piezoelectric actuator 12, as shown in FIG. 4, has a stacked body in which at least two piezoelectric material layers 12*a* and 12*b* are stacked. The piezoelectric material layers 12*a* and 12*b* which form the stacked body are made of a ceramics material (piezoelectric sheet) of lead zirconate titanate (PZT) which is a ferroelectric material, and are polarized in a direction of thickness thereof.

Figure 5:
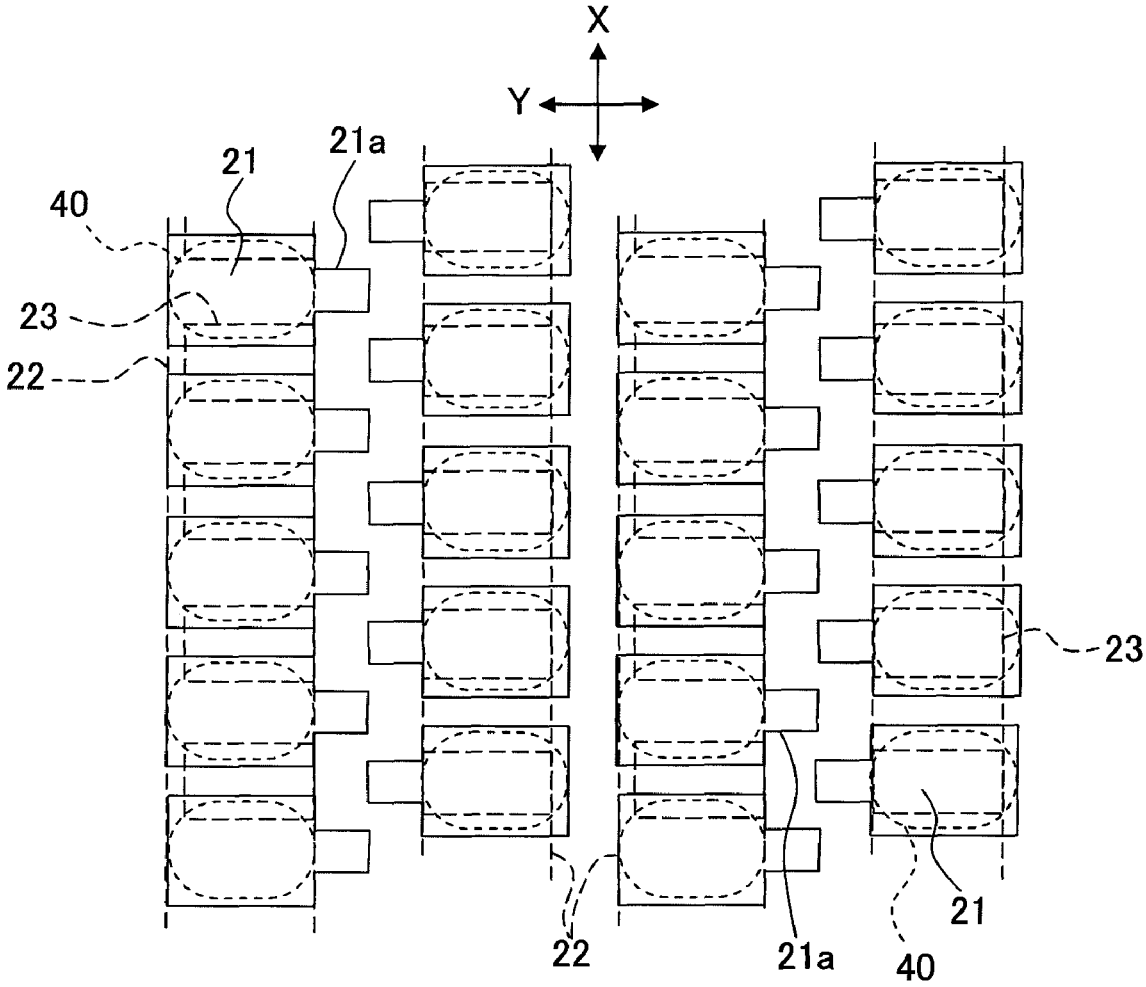
FIG. 5 is a diagram when the arrangement of electrodes in the piezoelectric material layer is seen in a plan view.
Figure 6:
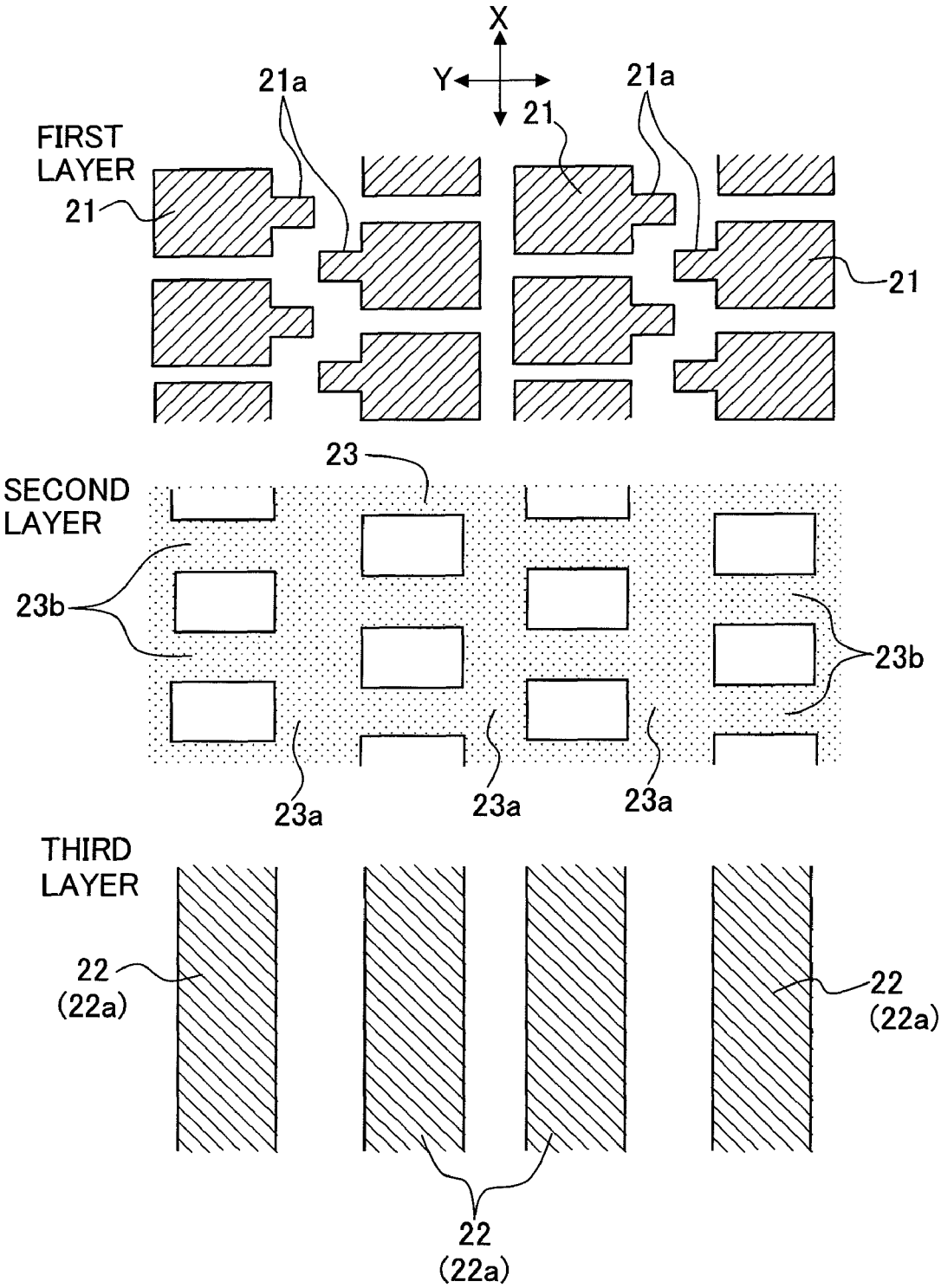
FIG. 6 is a diagram showing electrodes for each piezoelectric material layer.

As shown in FIGS. 5 and 6, in a plan view (when seen from a direction of stacking of the cavity unit 11 and the piezoelectric actuator 12), the piezoelectric actuator 12 includes a plurality of individual electrodes 21 corresponding to the pressure chambers 40, a first common constant electric potential electrode 22 which is formed corresponding to an outer peripheral portion of the pressure chambers 40, and a second common constant electric potential electrode 23 which is formed corresponding to central portions of the individual electrodes 21. Here, the piezoelectric material layers 12*a* and 12*b* are arranged between the first common constant electric potential electrode 22 and the individual electrodes 21, and the piezoelectric material layer 12*b* is arranged between the second common constant electric potential electrode 23 and the individual electrodes 21. In other words, the second common constant electric potential electrode 23 is formed between the piezoelectric material layers 12*a* and 12*b* which form the stacked body, the individual electrodes 21 are arranged on an upper surface (one surface) of the stacked body (piezoelectric material layers 12*a* and 12*b*), and the first common constant electric potential electrode 22 is formed on a lower surface (the other surface) of the stacked body (piezoelectric material layers 12*a* and 12B). Still in other words, the individual electrodes 21 and the second common constant electric potential electrode 23 are formed to sandwich the piezoelectric material layer 12*a*, and the first common constant electric potential electrode 22 and the second common constant electric potential electrode 23 are formed to sandwich the piezoelectric material layer 12*b*. Here, central portions of the individual electrodes 21 are central portions of the individual electrodes 21 in the pressure chamber row direction X in which the pressure chambers 40 are arranged (which is also a nozzle row direction in which the nozzle holes 16*a* are arranged). The individual electrodes 21, the first common constant electric potential electrode 22, and the second common constant electric potential electrode 23 are formed of an Ag—Pd (based) metallic material.

Each of the individual electrodes 21 has a terminal portion 21*a* which is arranged to overlap with an outer side of one of the pressure chambers 40, and a voltage is applied to the terminal portion 21*a* by the voltage applying mechanism.

The second common constant electric potential electrode 23 has a plurality of first portions 23*a* extended in a row direction of pressure chamber rows, between the adjacent pressure chamber rows, and a plurality of second portions 23*b* which are provided corresponding to the pressure chambers 40, and which connect the two adjacent first portions 23*a*, and these second portions 23*b* are extended in a direction orthogonal to (intersecting) the row direction of pressure chamber rows. Accordingly, the second common constant electric potential electrode 23 is formed to be in the form of a mesh, thereby facilitating a reduction in impedance. Accordingly, by the reduction in impedance, a voltage drop is suppressed, and same jetting performance (jetting characteristics) is (are) achieved for nozzles communicating with any pressure chambers 40.

Moreover, the first common constant electric potential electrode 22 has a plurality of third portions 22*a* extended in the row direction of the pressure chamber rows, overlapping with the plurality of pressure chambers 40 included in the pressure chamber row, and fourth portions 22*b* which connect end portions of the plurality of third portions 22*a*. The third portions 22*a* are provided not to overlap with the first portions 23*a* of the second common constant electric potential electrode 23.

Moreover, a plurality of active portions S1 is formed by the piezoelectric material layer sandwiched between the individual electrodes 21 and the second common constant electric potential electrode 23 (second portions 23*b*), and a plurality of second active portions S2 is formed by the piezoelectric material layer sandwiched between the individual electrodes 21 and the first common constant electric potential electrode 22 (third portions 22*a*). Here, since the reduction in impedance is facilitated by forming the second common constant electric potential electrode 23 which is involved in the formation of the first active portion S1 in the form of a mesh, the voltage drop is suppressed in the second common constant electric potential electrode 23, and the same jetting performance is achieved for nozzles communicating with any of the pressure chambers 40.

A driver IC 90 (refer to FIG. 1B) which supplies a drive signal is electrically connected to individual electrodes 21 through the flexible circuit board 13 (signal wire). The driver IC 90 and the flexible circuit board 13 form a voltage applying mechanism which applies a voltage to the first active portions S1 and the second active portions S2 of the piezoelectric actuator 12.

A positive electric potential (a second electric potential) and a ground electric potential (a first electric potential) applied selectively as a drive signal to the individual electrode 21, are applied to the piezoelectric actuator 12. Accordingly, when a volume of the pressure chambers 40 are changed, the ink is jetted from the nozzle holes 16*a*.

More elaborately, the individual electrodes 21, as shown in FIGS. 5 and 6, have a rectangular shape in a plan view. Each of the individual electrodes 21 is longer than one of the pressure chambers 40 in X-direction of the pressure chamber rows and shorter than one of the pressure chambers 40 in Y-direction orthogonal to the X-direction of the pressure chamber rows, and is formed to be spreading over corresponding one of the first active portions S1 and corresponding one of the second active portions S2. The second common constant electric potential electrode 23 is shorter than each of the pressure chambers 40 in X-direction of the pressure chamber rows, and is formed to occupy an area of the piezoelectric material layer corresponding to the first active portions S1. Moreover, the first common constant electric potential electrode 22 positioned toward (on a side of) the pressure chambers 40 is formed to be longer than the second common constant electric potential electrode 23, in the X-direction of the pressure chamber rows. In other words, each individual electrode 21 is shared by the first common constant electric potential electrode 22 and the second common constant electric potential electrode 23.

The first common constant electric potential electrode 22 is formed to cover areas of the piezoelectric material layer corresponding to the second active portions S2, and areas of the piezoelectric material layer corresponding to columnar portions 41 between the adjacent pressure chambers 40 in the X-direction. In other words, the first common constant electric potential electrode 22 is extended in X-direction of the pressure chamber rows to cover the columnar portion 41, and is shared by the pressure chambers 40 adjacent in the X-direction of the pressure chamber rows.

Concretely, when the individual electrodes 21 are formed on an upper surface side of the upper piezoelectric material layer 12*a* and when the second common constant electric potential electrode 23 is formed on a lower surface side of the upper piezoelectric material layer 12*a*, the active portion S1 is formed. Moreover, when the first common constant electric potential electrode 22 is formed on a lower surface side of the lower piezoelectric material layer 12*b*, the second active portion S2 is formed.

In a plan view, the individual electrodes 21, the first common constant electric potential electrode 22, and the second common constant electric potential electrode 23 are arranged as shown in FIG. 6, in each piezoelectric material layer 12*a* and 12*b*. In other words, the individual electrodes 21 are formed on the upper surface (first layer) of the piezoelectric material layer 12*a*, corresponding to the pressure chambers 40 respectively, at a constant pitch in the X-direction of the pressure chamber row. Moreover, the adjacent individual electrodes 21 are formed to be shifted by a half pitch in X-direction of the pressure chamber row, and terminal portions 21*a* of the individual electrodes 21 to be connected to connecting terminals (not shown in the diagram) of the flexible circuit board 13 are formed in a zigzag form.

The second portions 23*b* of the second common constant electric potential electrode 23 are arranged on the lower surface (second layer) of the piezoelectric material layer 12*a*, corresponding to the pressure chambers 40, and both end portions of each of the second portions 23*b* are connected to the first portions each extended in the direction of pressure chamber row, between the adjacent pressure chamber rows. Moreover, since the third portions 22*a* of the first common constant electric potential electrode 22 are located between the two adjacent first portions 23*a*, and are extended in the direction of pressure chamber row, the third portions 22*a* do not overlap with the first portions 23*a* of the second common constant electric potential electrode 23.

Figure 7:
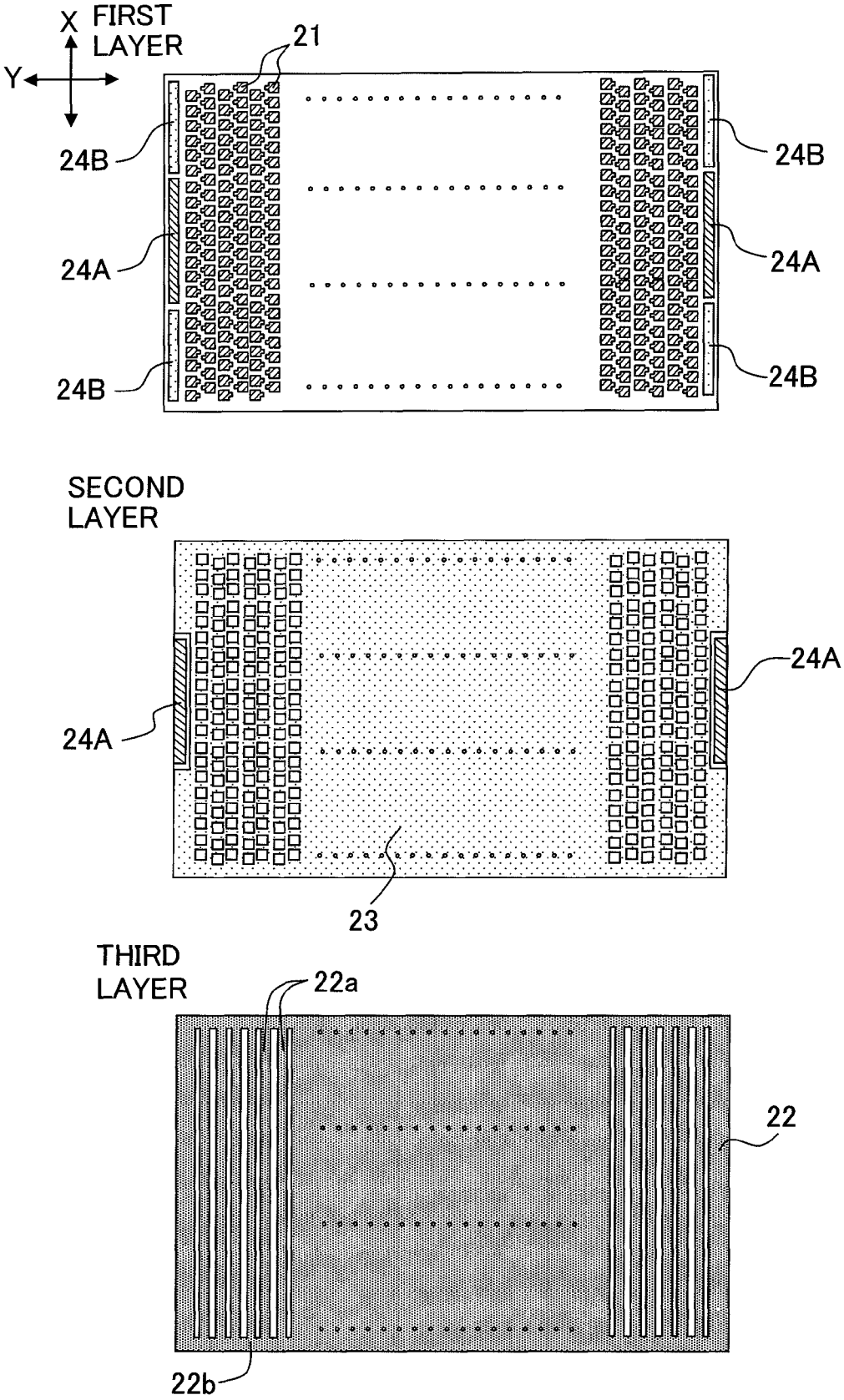
FIG. 7 is a diagram showing an electrode pattern for each piezoelectric material layer.

As shown in FIG. 7, connecting terminals 24A each of which is brought into conduction with the first common constant electric potential electrode 22 via a through hole filled with an electroconductive material, are formed, on the upper surface of the piezoelectric material layer 12*a*, at a center of each of the two end portions thereof in Y-direction, for connection of wires to the first common constant electric potential electrode 22 and the second common constant electric potential electrode 23. Furthermore, connecting terminals 24B each of which is brought into conduction with the second common constant electric potential electrode 23 via a through hole filled with an electroconductive material, are formed on the upper surface of the piezoelectric material layer 12*a*, at each of the two end portions thereof in Y-direction, at both ends in X-direction of each of the two end portions.

As shown in FIG. 4, the first active portion S1 is polarized in a direction (direction of polarization) same as a direction of an electric field which is generated when a ground electric potential is applied to the individual electrodes 21 and a positive electric potential is applied to the second common constant electric potential electrode 23. On the other hand, the second active portion S2 is polarized in a direction same as a direction of an electric field which is generated when a positive electric potential is applied to the individual electrodes 21 and a ground electric potential is applied to the first common constant electric potential electrode 22. In other words, at the time of an ink jetting operation, the direction of the electric field and the direction of polarization are the same.

The second common constant electric potential electrode 23 is kept at the positive electric potential all the time and the first common constant electric potential electrode 22 is kept at the ground electric potential all the time. The positive electric potential and the ground electric potential are selectively applied to the individual electrodes 21 for changing the volume of the pressure chambers 40. In other words, the direction of the electric field is same at the time of polarization and at the time of driving, the second common constant electric potential electrode 23 is kept at the positive electric potential all the time, the first common constant electric potential electrode 22 is kept at the ground electric potential all the time, and the electric potentials applied to the individual electrodes are selectively changed between the positive electric potential and the ground electric potential. Accordingly, when the ground electric potential is applied to the individual electrodes 21, a voltage is applied to the first active portions S1, but no voltage is applied to the second active portions S2. On the other hand, when the positive electric potential is applied to the individual electrodes 21, no voltage is applied to the first active portions S1, but a voltage is applied to the second active portions S2. Here, since a voltage to be applied between the electrodes at the time of driving is smaller than a voltage to be applied at the time of polarization, a deterioration is suppressed by applying the voltage repeatedly between the electrodes.

The individual electrodes 21, the first common constant electric potential electrode 22, and the second common constant electric potential electrode 23 are arranged in such manner. When the ink is jetted, firstly, the ground electric potential is applied to the individual electrodes 21 by the voltage applying mechanism. Accordingly, an electric field in a direction same as the direction of polarization is generated in the first active portions S1. At this time, the first active portions S1 elongates in a stacking direction Z (first direction) directed toward the pressure chambers 40 and contracts in X and Y directions (second direction, in-plane direction) orthogonal to the stacking direction Z, due to a piezoelectric transverse effect, and is deformed to form a projection toward the pressure chambers 40 (stand-by state).

Next, when the positive electric potential (such as 20V) is applied to the individual electrodes 21, the active portions S1 is a non-deformed state in which the active portions S1 do not elongate in the stacking direction Z and contract in X and Y directions orthogonal to the stacking direction Z. At this time, a voltage is applied to the second active portions S2, and the second active portions are elongate in the stacking direction Z (first direction) directed toward the pressure chamber 40, and contract in X and Y directions (second direction) orthogonal to the stacking direction Z. At this time, due to a function of the top plate 15 as a confining plate, the second active portions S2 positioned at both side portions in the row direction X of the pressure chambers are deformed to be curved (warped) in a direction away from the pressure chambers 40. The deformation of the second active portions S2 contributes to making substantial a change in the volume of the pressure chamber 40, and contributes to sucking a large amount of ink into the pressure chambers 40 from the manifold 50.

Further, when the ground electric potential is applied to the individual electrodes 21 once again, the first active portions S1 elongate in the stacking direction Z directed toward the pressure chambers 40, and contracts in X and Y directions orthogonal to the stacking direction Z. Then, the first active portions deform to form a projection directed toward the pressure chambers 40. Therefore, the volume of the pressure chambers 40 decreases, and a pressure in the ink increases, and the ink is jetted from the nozzle holes 16*a*.

When the ground electric potential is applied to the individual electrodes 21, the ink is jetted by driving the first active portions S1. Then, both the individual electrodes 21 and the first common constant electric potential electrode 22 are at the ground electric potential. Therefore, no voltage is applied to the second active portions S2 (no-voltage applied state). Accordingly, the second active portions S2 regains a non-deformed state in which the second active portions S2 are not elongated and contracted in any of the Z, X and Y directions. In other words, when the first active portions S1 undergoes deformation to form a projection in the direction of the pressure chambers 40 (stacking direction Z), the second active portions S2 regains a state of no-deformation (non-deformed state). This regaining of the second active portions is equivalent to a deformation in which the second active portions are contracted in the stacking direction Z and elongated in two directions X and Y orthogonal to the stacking direction Z. Therefore, an effect of the deformation of the first active portions S1 is suppressed by being counterbalanced by the deformation of the second active portions S2, and hardly reach the pressure chambers 40 adjacent in the row direction X, and the pressure chambers 40 adjacent in Y-direction which is orthogonal to X-direction, and the cross-talk is suppressed. In other words, applying the voltage and not applying the voltage to the second active portions S2 (second portion) is switched such that the propagation of the deformation of the first active portions S1 (first portion) to the adjacent pressure chambers 40 which are adjacent on both sides in the row direction X is suppressed, the deformation being generated by switching to applying and not applying the voltage to the first active portions.

Thereafter, when the individual electrodes 21 are at the same electric potential as the second common constant electric potential electrode 23 (positive electric potential) again, as it has been described above, the first active portions S1 become a non-deformed state, and the second active portions S2 are deformed to be curled in the direction away from the pressure chambers 40. Therefore, the ink is sucked into the pressure chambers 40 from the manifold 50.

When the deformation of the first active portions S1 and the second active portions S2 are repeated, the jetting operation of the ink is also repeated, and in each of the jetting operations, a jetting efficiency is improved by making substantial (by increasing) the change in the volume of the pressure chambers 40, and also the cross-talk is suppressed.

Second Embodiment

Figure 8:
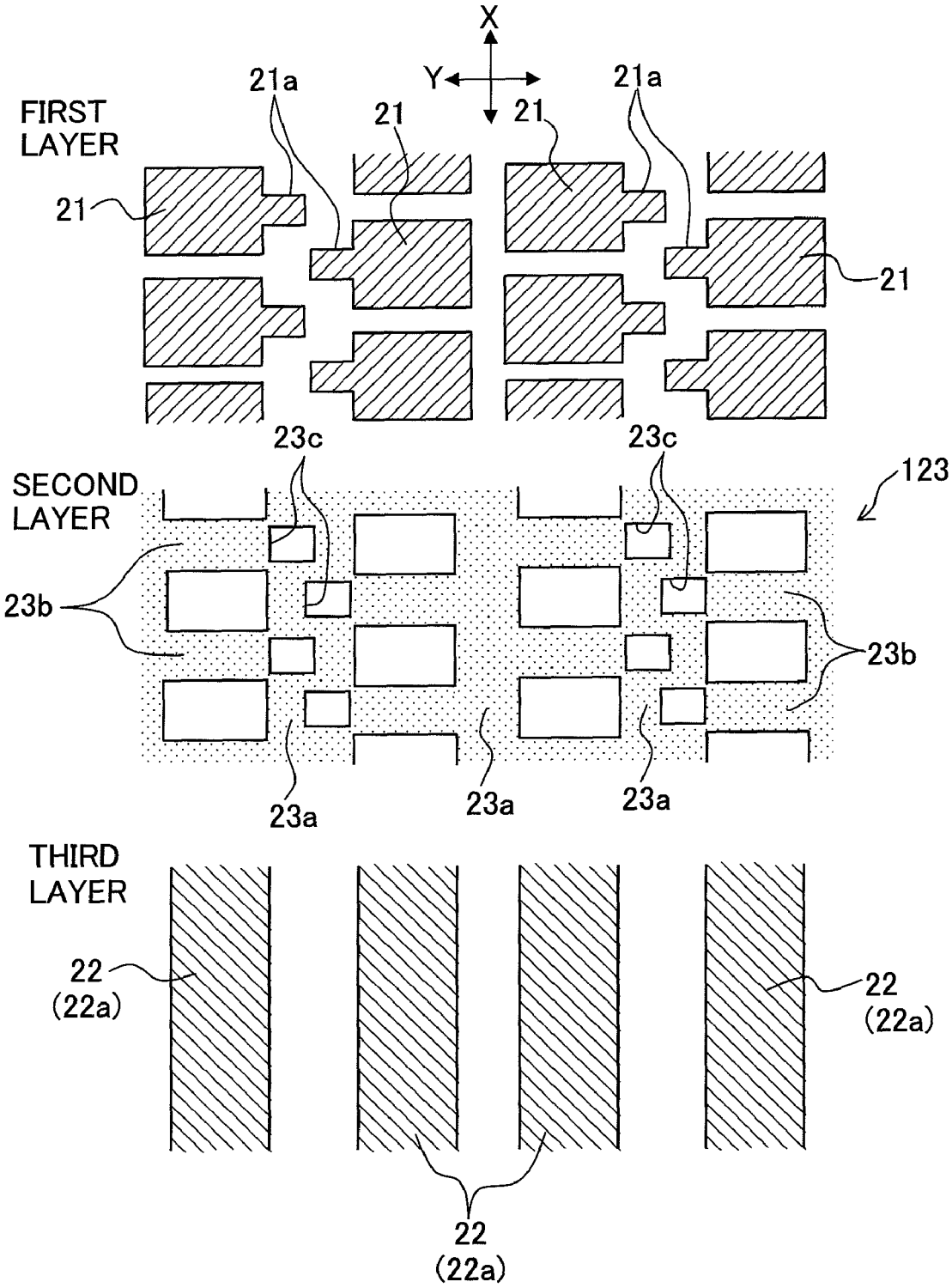
FIG. 8 is a diagram similar to FIG. 6, of a modified embodiment of the first embodiment.
Figure 9:
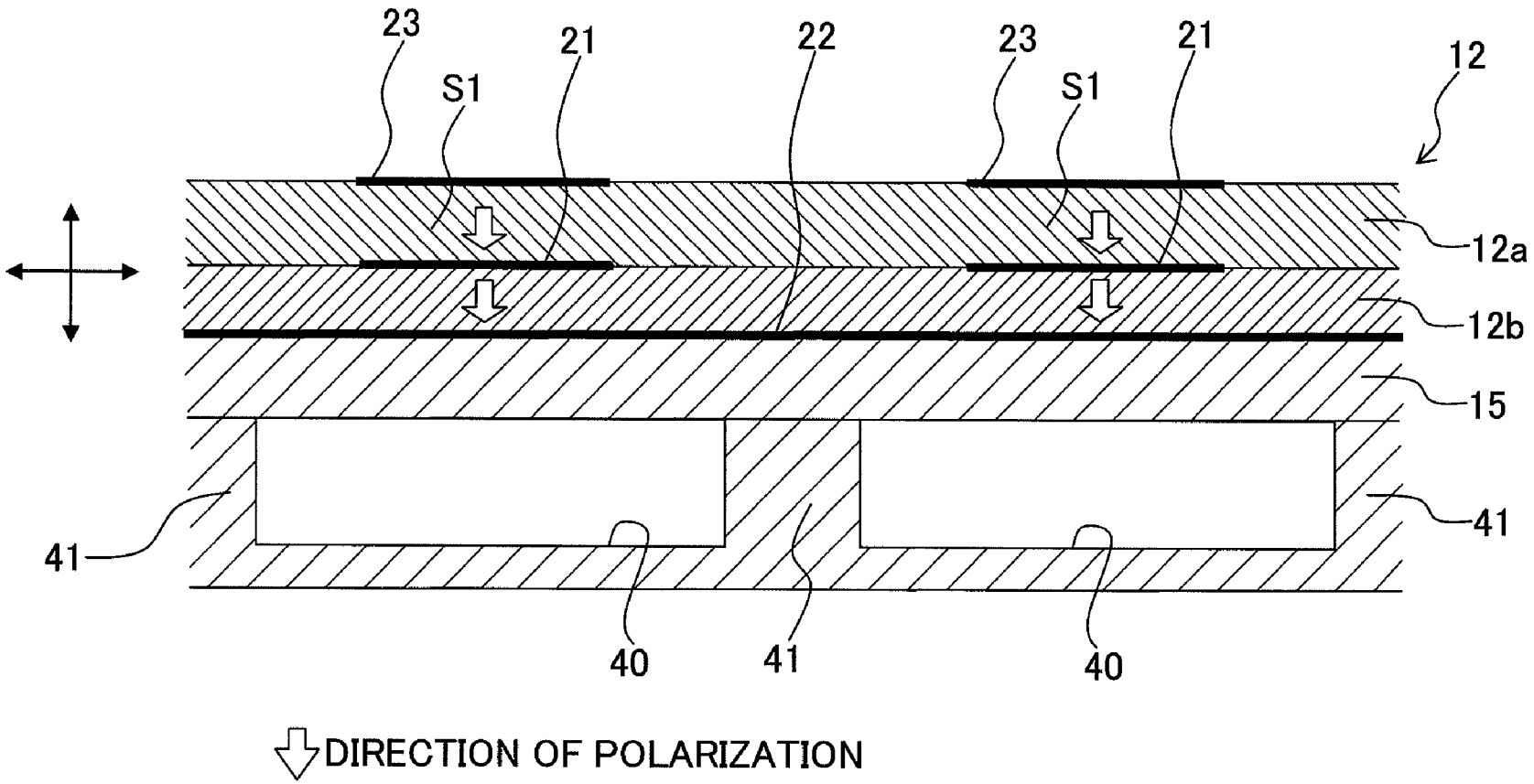
FIG. 9 is a cross-sectional view taken along a IX-IX line in FIG. 11, of a second embodiment.
Figure 10:
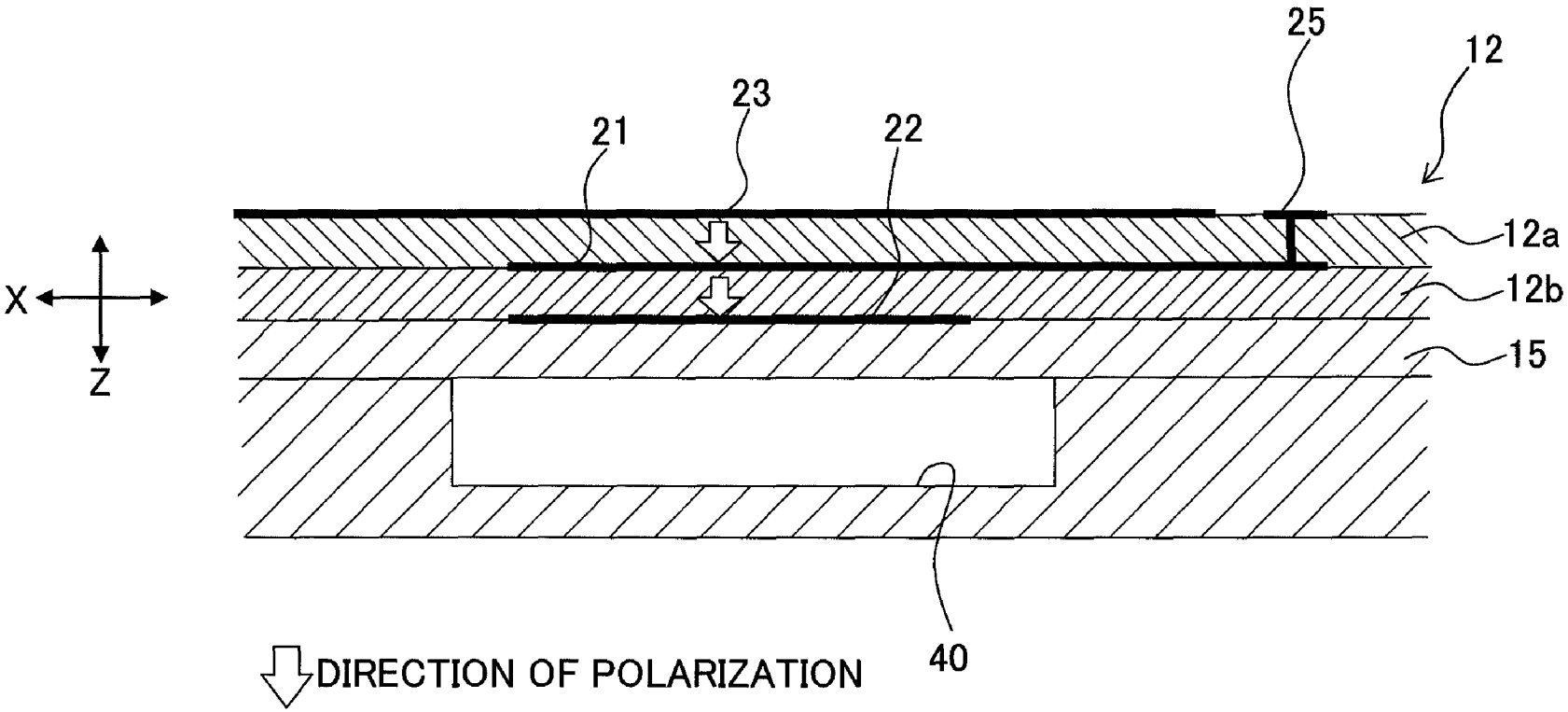
FIG. 10 is a cross-sectional view taken along a X-X line in FIG. 11, of the second embodiment.
Figure 11:
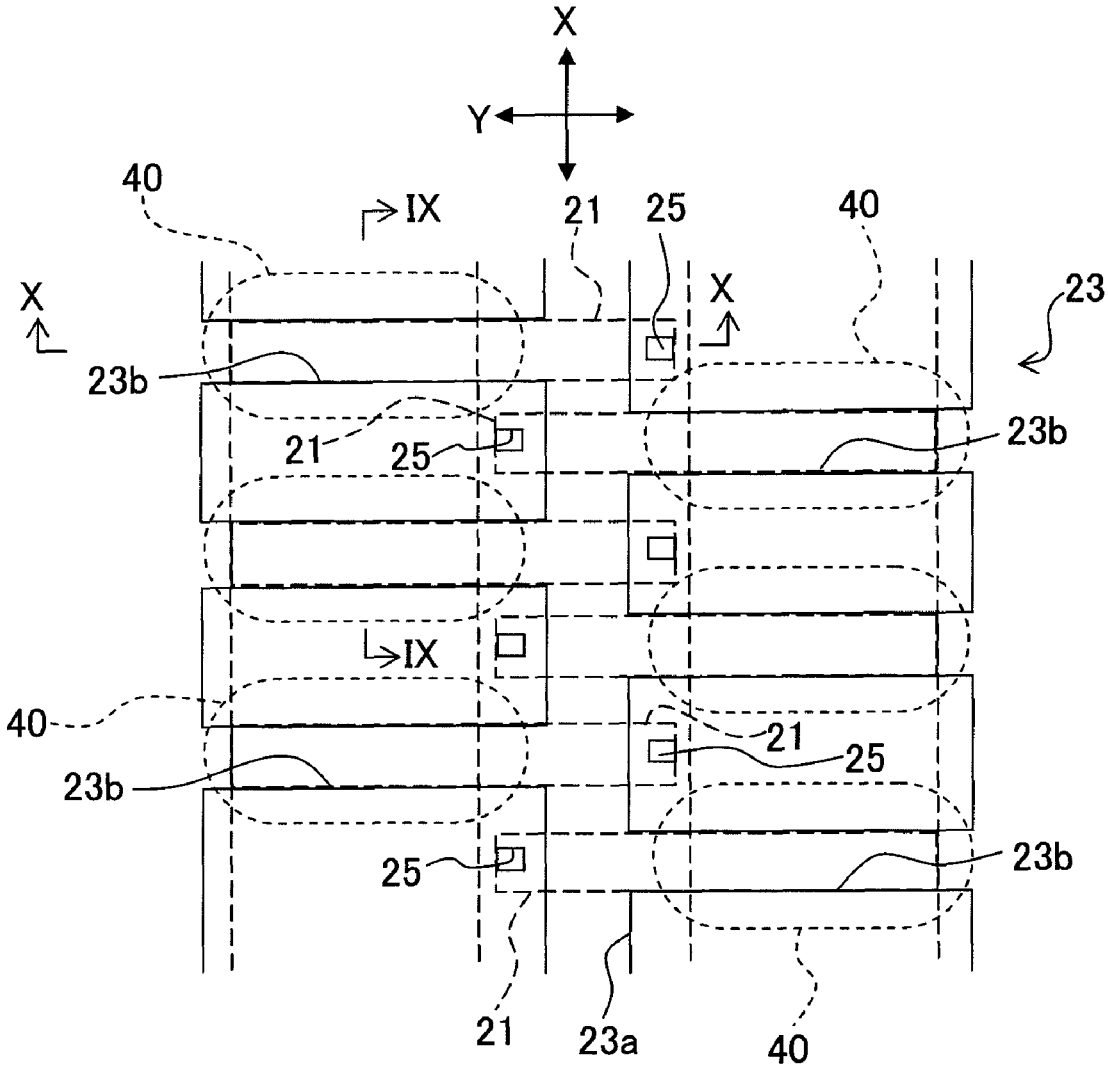
FIG. 11 is a diagram similar to FIG. 5, of the second embodiment.
Figure 12:
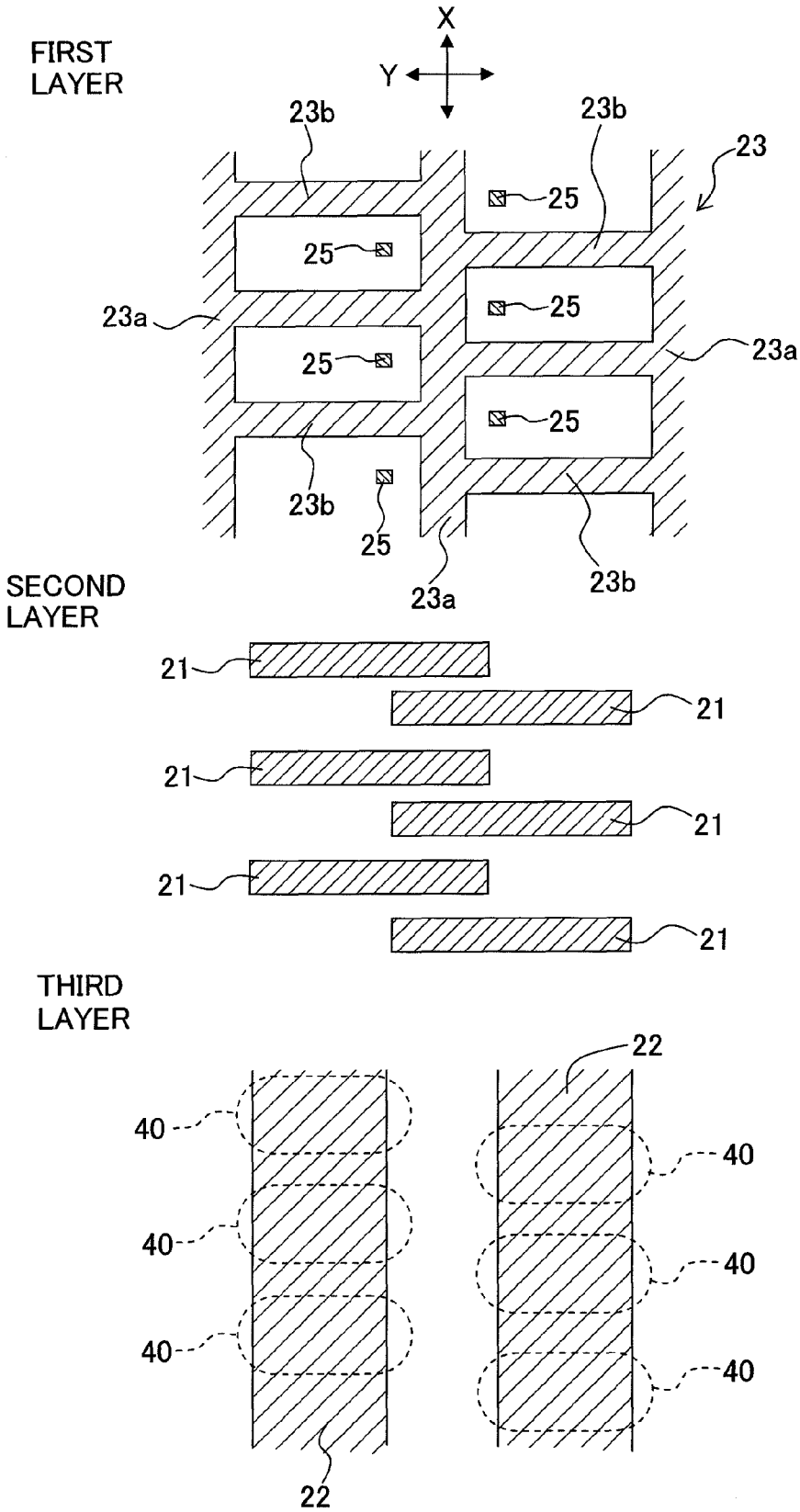
FIG. 12 is a diagram similar to FIG. 6, of the second embodiment.

In a case of a second embodiment, in a plan view, a portion sandwiched between the second common constant electric potential electrode 23 and the terminal portions 21*a* of the individual electrodes 21 arranged on an outer portion (columnar portion 41) of the pressure chambers 40 also function as the first active portions. There is a possibility that these portions act to suppress the entire first active portions from being deformed at the time of ink jetting. Therefore, as shown in FIG. 8, it is also possible to form a second common constant electric potential electrode 123, such that openings 23*c* (voids) are formed at areas, of the second common constant electric potential electrode 123, overlapping with the terminal portions 21*a* of the individual electrodes 21 in a plan view. These openings 23*c* are formed in the first portions 23*a*. In the first embodiment described above, the individual electrodes 21 are formed on the upper surface of the upper piezoelectric material layer, and the mesh-shaped second common constant electric potential electrode 23 is formed on the lower surface of the piezoelectric material layer. However, as shown in FIGS. 9, 10, 11, and 12, the mesh-shaped second common constant electric potential electrode 23 may be formed on the upper surface of the upper piezoelectric material layer 12*a*, and the individual electrodes 21 may be formed on the lower surface of the upper piezoelectric material layer 12*a*. Moreover, a plurality of first active portions S1 are formed in portions of the piezoelectric material layer sandwiched between the individual electrodes 21 and the second common constant electric potential electrode 23, and second active portions S2 are formed in portions of the piezoelectric material layer sandwiched between the individual electrodes 21 and the first common constant electric potential electrode 22. In other words, the first active portions S1 and the second active portions S2 are arranged corresponding to the central portion of the pressure chambers 40, and are formed to mutually overlap vertically. In this case, for wiring to the individual electrodes 21, it is necessary that through holes 25 filled with an electroconductive material are formed for the terminal portions 21*a* of the individual electrodes 21, and that the terminal portions 21*a* of the individual electrodes 21 are guided to the upper surface of the upper piezoelectric material layer 12*a*.

Moreover, similarly as in the first embodiment, the ground electric potential is applied to the first common constant electric potential electrode 22 formed on the lower surface of the lower piezoelectric material layer 12*b*, and the positive electric potential is applied to the second common constant electric potential electrode 23, and the positive electric potential and the ground electric potential are applied selectively to the individual electrodes 21. The ground electric potential is applied to the individual electrodes 21 corresponding to pressure chambers which do not jet ink.

In a stand-by state in which a power supply is put ON, the individual electrodes 21 are let to be at the ground electric potential. At this time, due to an electric potential difference developed between the individual electrodes 21 and the second common constant electric potential 23, an electric field in a thickness direction of the piezoelectric layer directed from the second common constant electric potential electrode 23 toward the individual electrodes 21 is generated in the first active portions S1 of the piezoelectric material layer 12*a* sandwiched between the individual electrodes 21 and the second common constant electric potential electrode 23. Since the direction of the electric field coincides with the direction of polarization of the piezoelectric material layer 12*a*, the active portions contract in a horizontal direction which is orthogonal to the direction of polarization. On the other hand, since the first common constant electric potential electrode 22 and the individual electrodes 21 are at the same electric potential, an electric field is not generated in the second active portion S2 of the piezoelectric material layer 12*b* sandwiched between the first common constant electric potential electrode 22 and the individual electrodes 21, and the second active portions S2 do not contract. Accordingly, portions of the piezoelectric material layers 12*a* and 12*b* corresponding to the pressure chambers 40 are deformed as a whole to form projections toward the pressure chambers 40.

At the time of jetting the ink from the nozzle 15, firstly, when the positive electric potential is applied to the individual electrodes 21 which is at the ground electric potential, an electric field in a thickness direction of the piezoelectric material layers directed from the individual electrodes 21 toward the first common constant electric potential electrode 22 is generated in the second active portions S2 of the piezoelectric material layer 12*b* sandwiched between the individual electrodes 21 and the first common constant electric potential electrode 22 due to an electric potential difference developed between the individual electrodes 21 and the first common constant electric potential electrode 22. Since the direction of the electric field coincides with the direction of polarization of the second active portions S2, the second active portions S2 contract in a horizontal direction (in-plane direction of the piezoelectric layers) which is orthogonal to the direction of polarization. On the other hand, since the second common constant electric potential electrode 23 and the individual electrodes 21 are at the same electric potential, an electric field is not generated in the first active portions S1 of the piezoelectric material layer 12*a*, and there is no contraction in the horizontal direction. Accordingly, portions of the piezoelectric material layer 12*b* corresponding to the pressure chambers 40 are deformed as a whole to form projections toward an opposite side of the pressure chambers 40, and the volume of the pressure chambers 40 are increased. Therefore, a pressure of (on) the ink in the pressure chambers 40 is decreased, and the ink flows from the manifold 50 to the pressure chambers 40.

Furthermore, upon elapsing of a predetermined time, when the ground electric potential is applied to the individual electrodes 21, the first active portions S1 of the piezoelectric material layer 12*a* are deformed once again to form projections toward the pressure chambers 40, and the pressure of (on) the ink in the pressure chambers 40 is increased, and the ink is jetted from the nozzles communicating with the pressure chambers 40.

In this manner, by applying selectively the positive electric potential and the ground electric potential to the individual electrodes 21, the piezoelectric material layers 12*a* and 12*b* are made to be deformed in advance to form a projection toward the pressure chamber 40, and by deforming the piezoelectric material layers 12*a* and 12*b* to form a projection toward the pressure chamber 40 once again after deforming once to form a projection toward the opposite side of the pressure chamber 40, it is possible to change substantially the volume of the pressure chamber 40, and as a result, it is possible to apply a substantial pressure on the ink in the pressure chamber 40. Accordingly, it is possible to jet the ink efficiently from the nozzle.

It is possible to modify the embodiments (the first embodiment and the second embodiment) described above as follows.

Figure 13:
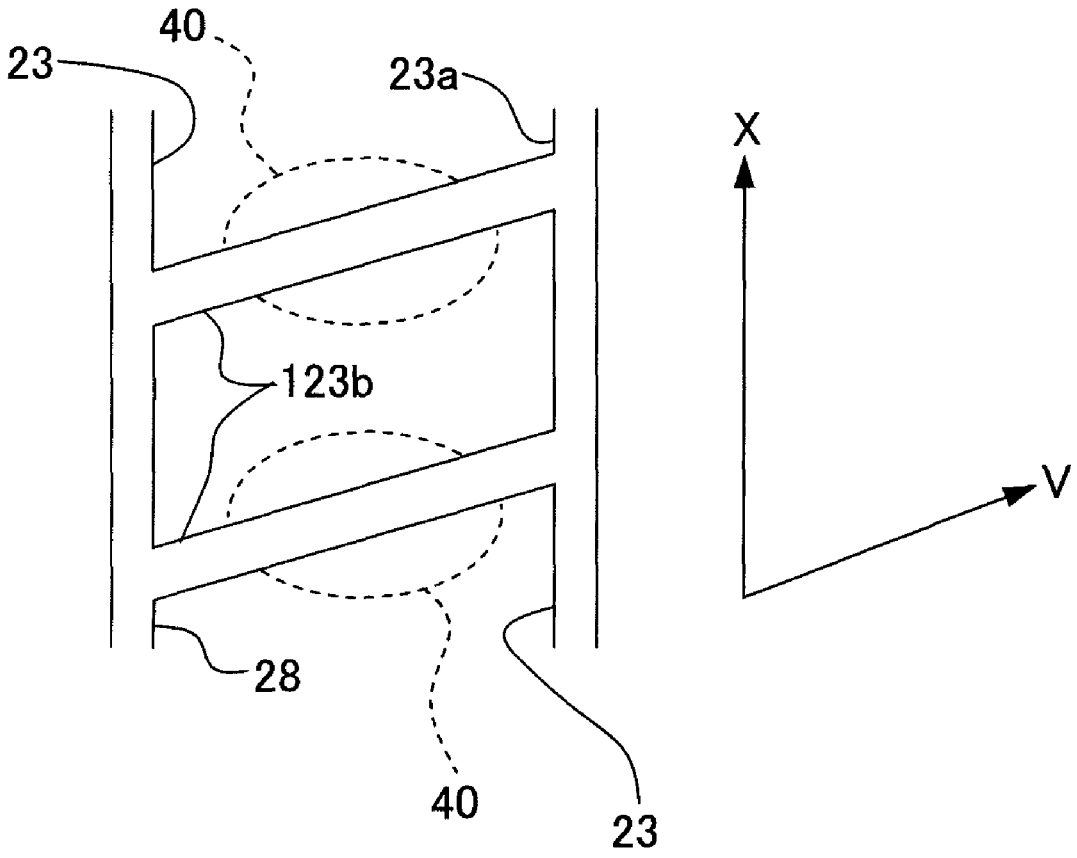
FIG. 13 is an explanatory diagram of a direction in which a second portion of a second common constant electric potential electrode is provided.
Figure 14:
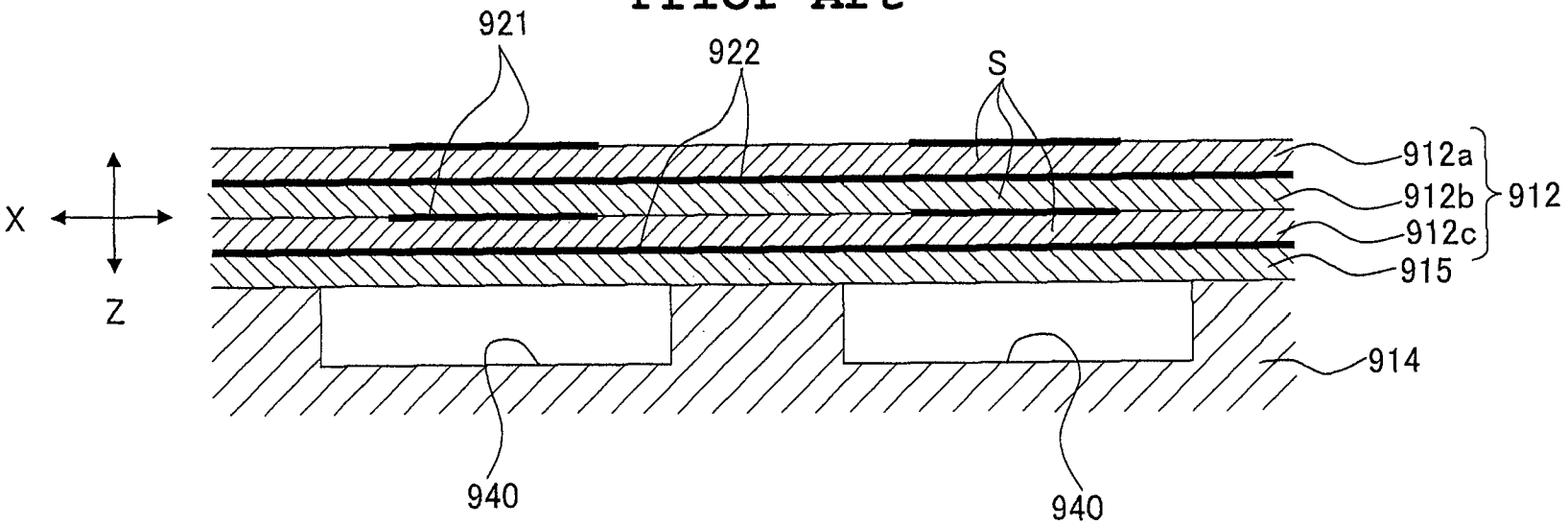
Fig. 14 Prior Art
FIG. 14 is a schematic cross-sectional view in a direction of pressure chamber rows, in a conventional example.
Figure 15:
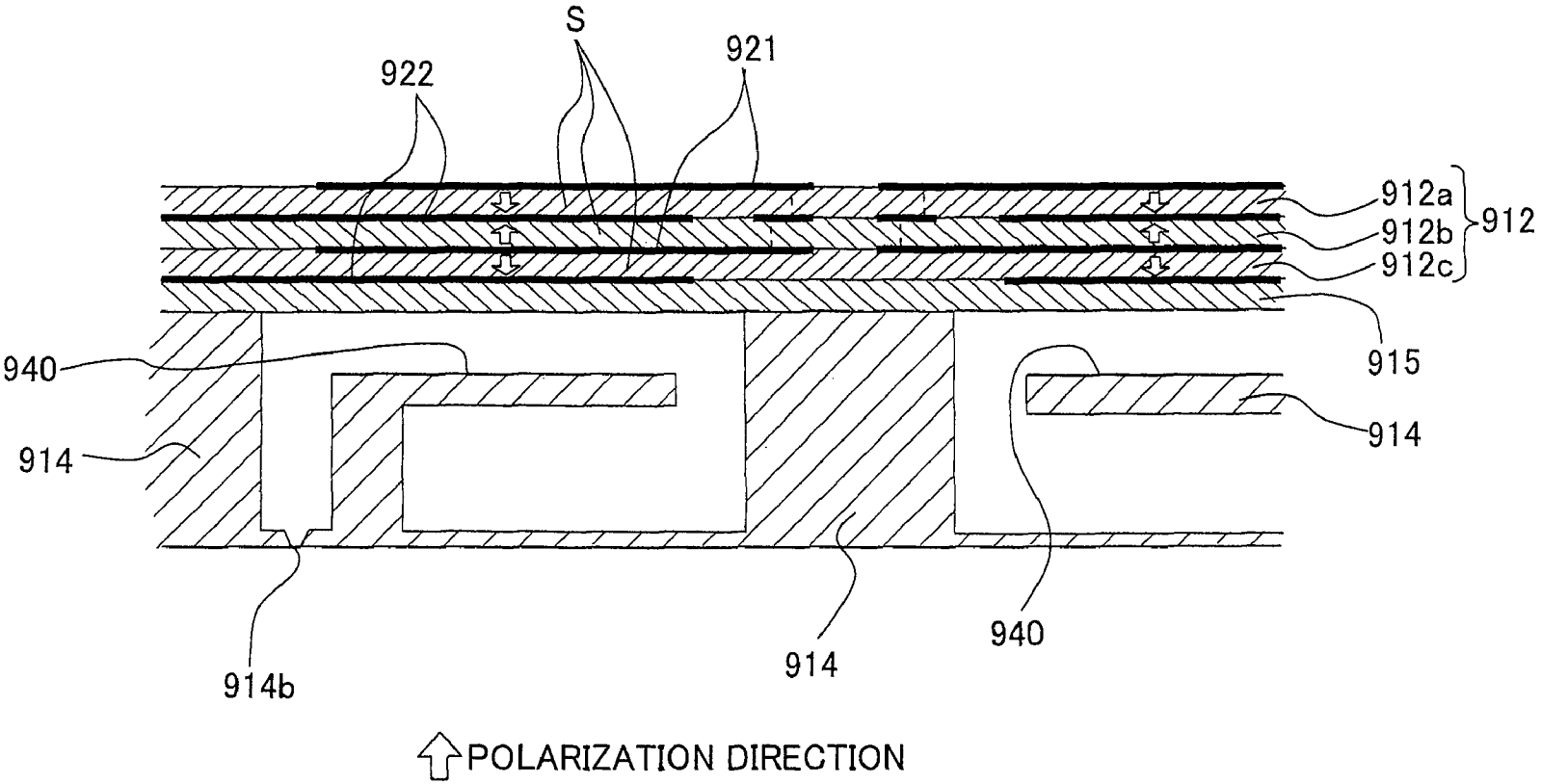
Fig. 15 Prior Art
FIG. 15 is schematic cross-sectional view in a direction orthogonal to the direction of pressure chamber rows, in the conventional example.
Figure 16:
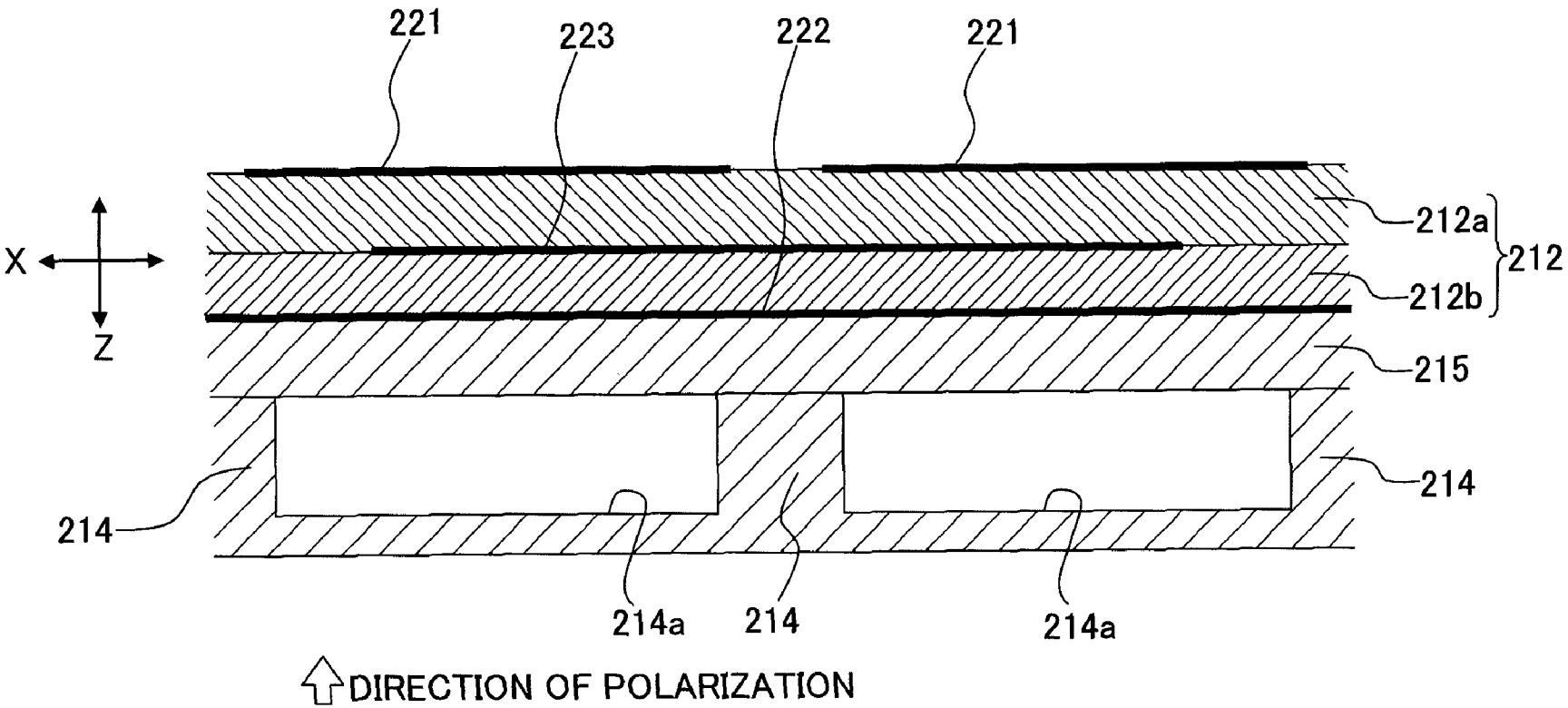
FIG. 16 is a diagram similar to FIG. 4, of an example for comparison.
Figure 17:
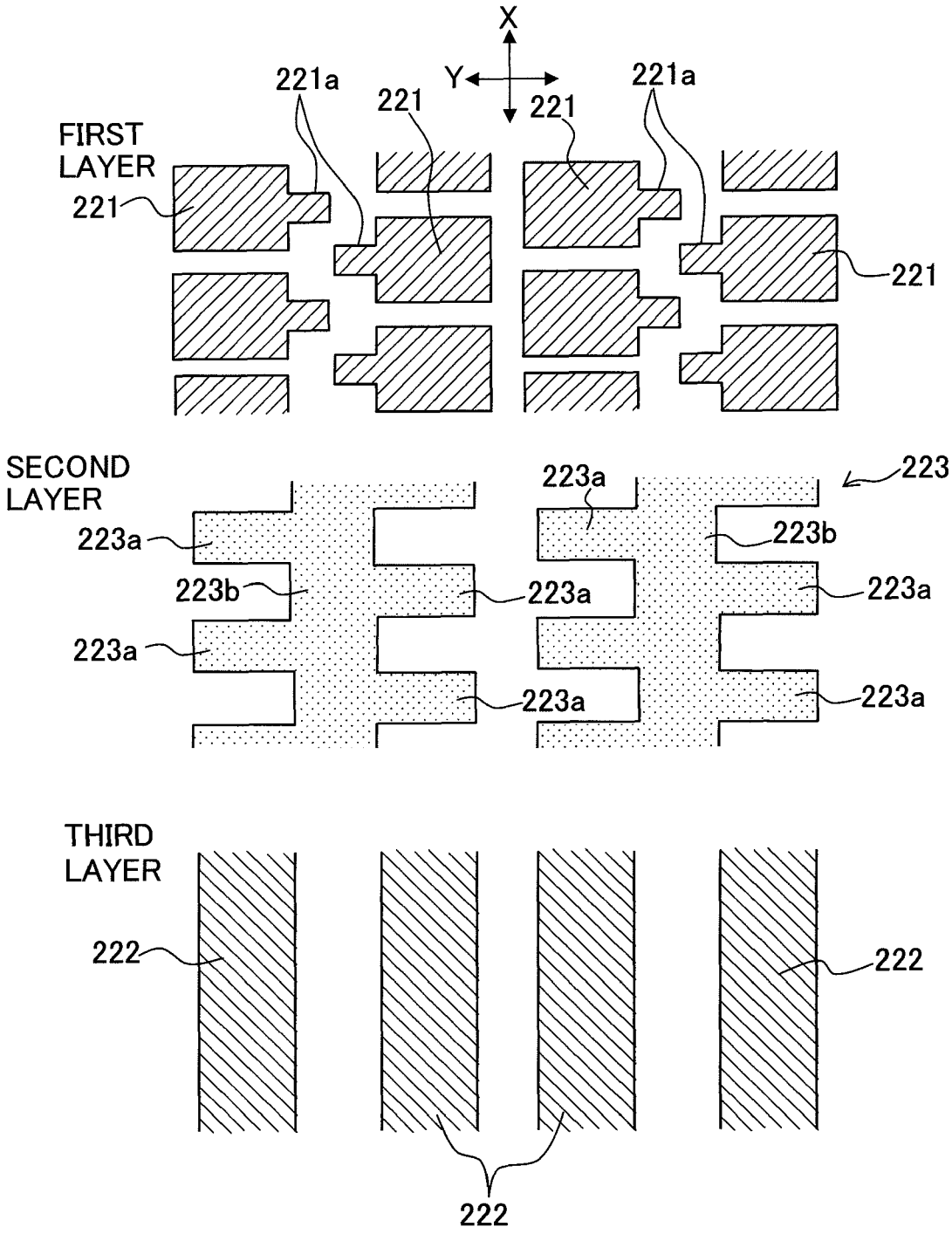
FIG. 17 is a diagram similar to FIG. 6, of an example for comparison.
Figure 18:
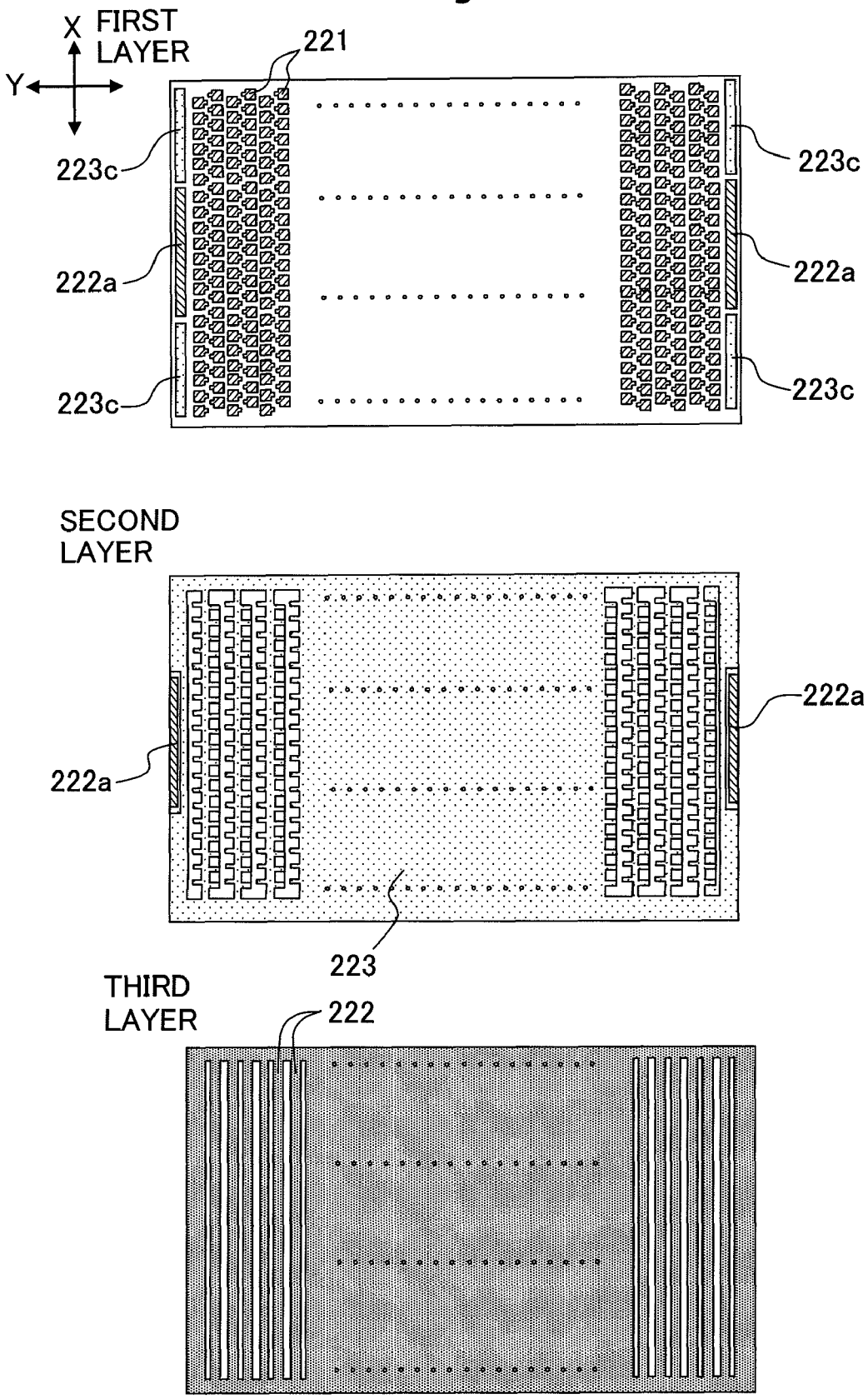
FIG. 18 is a diagram similar to FIG. 7, of an example for comparison.

In the embodiments described above, the second portions 23*b* of the second common constant electric potential electrode 23 are formed to be arranged in Y-direction which is orthogonal to the row direction X. However, the present invention is not restricted to this arrangement, and the second portions 23*b* of the second common constant electric potential electrode 23 may have portions overlapping with the pressure chambers 40. For example, as shown in FIG. 13, second portions 123*b* may be arranged in an intersecting direction V which is inclined with respect to the row direction X. When the second portions 123*b* are formed to be inclined with respect to a direction orthogonal (to a predetermined direction), it is possible to provide third active portions on one side in the intersecting direction V corresponding to the direction of inclination, and to provide third active portions and fourth active portions on both sides in the intersecting direction V.

In the first embodiment and the second embodiment, a case in which the liquid droplet jetting apparatus is an ink-jet printer has been explained. However, the present invention is not restricted to this and the present invention is also applicable to other liquid droplet jetting apparatuses such as an apparatus which jets an electroconductive liquid to form a wiring pattern or an apparatus which jet a colored liquid as fine liquid droplets to apply it onto a recording medium.

In the present invention, not only a recording paper but also various objects such as a resin and a cloth can be used as a recording medium, and moreover, not only an ink but also various liquids such as a colored liquid and a function liquid (a coolant, an electro conductive liquid, or the like) can be used as a liquid to be jetted.

What is claimed is:

1. A liquid droplet jetting apparatus which jets a droplet of a liquid onto a medium, comprising:

a liquid droplet jetting head which jets the droplet, including:

a cavity unit in which a plurality of pressure chamber rows each having a plurality of pressure chambers aligned in a row direction is formed; and a piezoelectric actuator which causes selectively the liquid in each of the pressure chambers to be jetted, and includes a plurality of piezoelectric material layers stacked covering the pressure chambers; a plurality of individual electrodes arranged on a first surface of the piezoelectric material layers, at positions corresponding to the pressure chambers, respectively; a first common constant electric potential electrode which is formed on a second surface of the piezoelectric material layers, which overlaps with a portion of each of the individual electrodes, and which forms a plurality of second active portions in areas of the piezoelectric material layers each sandwiched between one of the individual electrodes and the first common constant electric potential electrode; and a second common constant electric potential electrode which is formed on a third surface of the piezoelectric material layers, which has a form of a mesh overlapping with a central portion of each of the individual electrodes, and which forms a plurality of first active portions in an area, of the piezoelectric material layers, each sandwiched between one of the individual electrodes and the second common constant electric potential electrode; and a voltage applying mechanism which applies a voltage to the piezoelectric actuator, wherein when a voltage is applied to the first active portions and the second active portions by the voltage applying mechanism, the first active portions and the second active portions both elongate in a first direction toward the pressure chambers, and contract in a second direction which is orthogonal to the first direction, respectively, and when the voltage applying mechanism applies the voltage to the first active portions, the voltage applying mechanism does not apply the voltage to the second active portions, and when the voltage applying mechanism does not apply the voltage to the first active portions, the voltage applying mechanism applies the voltage to the second active portions.

2. The liquid droplet jetting apparatus according to claim 1, wherein the first common constant electric potential electrode is formed corresponding to an edge portion of each of the pressure chambers.

3. The liquid droplet jetting apparatus according to claim 2, wherein the piezoelectric material layers are two piezoelectric material layers, and the second common constant electric potential electrode is formed between the two piezoelectric material layers, and one of the two piezoelectric material layers is sandwiched between the second common constant electric potential electrode and the first common constant electric potential electrode, and the other of the two piezoelectric material layers is sandwiched between the second common constant electric potential electrode and the individual electrodes.

4. The liquid droplet jetting apparatus according to claim 3, wherein the first active portions are polarized in a direction which is same as a direction of an electric field which is generated in the first active portions when a first electric potential is applied to the individual electrodes and when a second electric potential is applied to the second common constant electric potential electrode; and the second active portions are polarized in a direction which is same as a direction of an electric field which is generated in the second active portions when the second electric potential is applied to the individual electrodes and when the first electric potential is applied to the first common constant electric potential electrode.

5. The liquid droplet jetting apparatus according to claim 2, wherein the individual electrodes have terminal portions via which the voltage is applied by the voltage applying mechanism; and the second common constant electric potential electrode is formed on the third surface of the piezoelectric material layers at portions which are different from another portions of the third surface overlapping with the terminal portions.

6. The liquid droplet jetting apparatus according to claim 2, wherein the voltage applying mechanism selectively applies, to the individual electrodes, a first electric potential and a second electric potential which differs from the first electric potential, applies the first electric potential to the first common constant electric potential electrode, and applies the second electric potential to the second common constant electric potential electrode.

7. The liquid droplet jetting apparatus according to claim 1, wherein the second common constant electric potential electrode has a plurality of first portions each arranged on the third surface, extending in the row direction, at areas between adjacent pressure chamber rows among the pressure chamber rows, and a plurality of second portions each of which extends in an intersecting direction intersecting the row direction, and each of which communicates two adjacent first portions among the first portions.

8. The liquid droplet jetting apparatus according to claim 7, wherein the first active portions are formed by portions of the piezoelectric material layers each of which is sandwiched between one of the individual electrodes and one of the second portions of the second common constant electric potential electrode.

9. The liquid droplet jetting apparatus according to claim 7, wherein the first common constant electric potential electrode has a plurality of third portions each of which extends in the row direction, and overlaps with the plurality of pressure chambers forming a pressure chamber row among the pressure chamber rows, and a fourth portion which communicates with end portions of the plurality of third portions; and the third portions do not overlap with the first portions.

10. The liquid droplet jetting apparatus according to claim 9, wherein each of the second active portions is formed by a portion of the piezoelectric material layers sandwiched between one of the individual electrodes and one of the third portions of the first common constant electric potential electrode.

11. A liquid droplet jetting apparatus which jets a droplet of a liquid onto a medium, comprising:

a liquid droplet jetting head which jets the droplet, including:

a cavity unit in which a plurality of pressure chamber rows each having a plurality of pressure chambers aligned in a row direction is formed;

a piezoelectric actuator which causes selectively the liquid in the pressure chambers to be jetted, and includes a plurality of piezoelectric material layers stacked covering the pressure chambers; a plurality of individual electrodes arranged on a first surface of the piezoelectric material layers, at positions corresponding to the pressure chambers, respectively; a first common constant electric potential electrode which is formed on a second surface of the piezoelectric material layers, which overlaps with a portion of each of the individual electrodes, and which forms a plurality of second active portions in areas of the piezoelectric material layers each sandwiched between one of the individual electrodes and the first common constant electric potential electrode; and a second common constant electric potential electrode which is formed on a third surface of the piezoelectric material layers, which has a form of a mesh overlapping with a central portion of each of the individual electrodes, and which forms a plurality of first active portions in areas of the piezoelectric material layers each sandwiched between one of the individual electrodes and the second common constant electric potential electrode; and a voltage applying mechanism which applies a voltage to the piezoelectric actuator, wherein the voltage applying mechanism switches, between a first mode for applying the voltage and a second mode for not applying the voltage, to one of the first active portions to change a volume of one of the pressure chambers, and switches, between a third mode for applying the voltage and a fourth mode for not applying the voltage, to one of the second active portions to suppress a deformation of the one of the first active portions from being propagated to an adjacent pressure chamber of the one of the pressure chambers due to the switching between the first and second modes.

12. A liquid droplet jetting head which jets a droplet of a liquid onto a medium, comprising:

a cavity unit in which a plurality of pressure chamber rows each having a plurality of pressure chambers aligned in a row direction is formed; and a piezoelectric actuator which causes selectively the liquid in the pressure chambers to be jetted, including:

a plurality of piezoelectric material layers stacked covering the pressure chambers, respectively;

a plurality of individual electrodes arranged on a first surface of the piezoelectric material layers, at positions corresponding to the pressure chambers;

a first common constant electric potential electrode which is formed on a second surface of the piezoelectric material layers, which overlaps with a portion of each of the individual electrodes, and which forms a plurality of second active portions in areas of the piezoelectric material layers, each sandwiched between one of the individual electrodes and the piezoelectric material layer; and a second common constant electric potential electrode which is formed on a third surface of the piezoelectric material layers, which has a form of a mesh overlapping with a central portion of each of the individual electrodes, and which forms a plurality of first active portions in areas, of the piezoelectric material layers, each sandwiched between one of the individual electrodes and the piezoelectric material layer.

13. The liquid droplet jetting head according to claim 12, wherein the first common constant electric potential electrode is formed corresponding to an edge portion of each of the pressure chambers.

14. The liquid droplet jetting head according to claim 12, wherein the second common constant electric potential electrode has a plurality of first portions each arranged on the third surface extending in the row direction, between adjacent pressure chamber rows among the pressure chamber rows, and a plurality of second portions each of which extends in a direction intersecting the row direction, each of which communicates two adjacent first portions among the first portions.

* * * * *